US011401649B2

(12) United States Patent
Ko et al.

(10) Patent No.: US 11,401,649 B2
(45) Date of Patent: Aug. 2, 2022

(54) WASHING APPARATUS AND CONTROL METHOD THEREOF

(71) Applicant: SAMSUNG ELECTRONICS CO., LTD., Suwon-si (KR)

(72) Inventors: Gi Hoon Ko, Seoul (KR); Simon Ireland, Seongnam-si (KR); Yeon-Young Nam, Goyang-si (KR); Ji Hyeoung Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 161 days.

(21) Appl. No.: 16/475,927

(22) PCT Filed: Nov. 14, 2017

(86) PCT No.: PCT/KR2017/012869
§ 371 (c)(1),
(2) Date: Jul. 3, 2019

(87) PCT Pub. No.: WO2018/128262
PCT Pub. Date: Jul. 12, 2018

(65) Prior Publication Data

US 2019/0345661 A1 Nov. 14, 2019

(30) Foreign Application Priority Data

Jan. 3, 2017 (KR) ..... 10-2017-0000863

(51) Int. Cl.
*D06F 33/37* (2020.01)
*D06F 34/18* (2020.01)
(Continued)

(52) U.S. Cl.
CPC ..... *D06F 39/022* (2013.01); *D06F 34/18* (2020.02); *D06F 39/028* (2013.01); *D06F 39/14* (2013.01);
(Continued)

(58) Field of Classification Search
USPC ..... 68/12.18, 17 R
See application file for complete search history.

(56) References Cited

U.S. PATENT DOCUMENTS 8,312,745 B2 11/2012 Hasse et al.
2007/0240456 A1 10/2007 Byun et al.
(Continued)

FOREIGN PATENT DOCUMENTS

EP 2325376 A1 5/2011
EP 2459797 B1 6/2012
(Continued)

OTHER PUBLICATIONS

European Office Action dated Nov. 13, 2020 from European Application No. 17890728.3, 5 pages.
(Continued)

*Primary Examiner* — Levon J Shahinian
(74) *Attorney, Agent, or Firm* — Staas & Halsey LLP

(57) ABSTRACT

A washing apparatus and a control method of the washing apparatus in which a detergent received in a detergent supply case capable of being inserted or separated is automatically supplied to a mixing tank or a softening agent received in a softening agent supply case capable of being inserted or separated is automatically supplied to the mixing tank. According to one embodiment of the washing apparatus and the control method thereof, the detergent automatically supplied from the detergent supply case capable of being inserted or separated and a washing water are mixed together and a detergent-mixed water is supplied to a washing tub, or the softening agent automatically supplied from the softening agent supply case capable of being inserted or separated and a washing water are mixed together and then a softening agent-mixed water is supplied to the washing tub.

15 Claims, 15 Drawing Sheets

(51) Int. Cl.

| | |
|---|---|
| ***D06F 39/02*** | (2006.01) |
| ***D06F 39/14*** | (2006.01) |
| *D06F 103/00* | (2020.01) |
| *D06F 103/04* | (2020.01) |
| *D06F 103/18* | (2020.01) |
| *D06F 103/22* | (2020.01) |
| *D06F 103/40* | (2020.01) |
| *D06F 105/42* | (2020.01) |
| *D06F 105/58* | (2020.01) |
| *D06F 101/20* | (2020.01) |

(52) U.S. Cl.
CPC ..... *D06F 33/37* (2020.02); *D06F 2101/20* (2020.02); *D06F 2103/00* (2020.02); *D06F 2103/04* (2020.02); *D06F 2103/18* (2020.02); *D06F 2103/22* (2020.02); *D06F 2103/40* (2020.02); *D06F 2105/42* (2020.02); *D06F 2105/58* (2020.02)

(56) References Cited

U.S. PATENT DOCUMENTS

| | | | | |
|---|---|---|---|---|
| 2010/0071729 | A1* | 3/2010 | Classen | D06F 39/022 134/93 |
| 2010/0139010 | A1* | 6/2010 | Lee | D06F 39/02 8/159 |
| 2013/0160500 | A1 | 6/2013 | Hendrickson | |
| 2016/0215434 | A1 | 7/2016 | Doyle et al. | |

FOREIGN PATENT DOCUMENTS

| | | | |
|---|---|---|---|
| EP | 2 719 815 | A1 | 4/2014 |
| EP | 2719815 | A1 | 4/2014 |
| EP | 2 459 797 | B1 | 10/2015 |
| EP | 2 325 376 | B1 | 7/2016 |
| EP | 2325376 | B1 | 7/2016 |
| JP | 2001-129292 | | 5/2001 |
| KR | 10-2008-0073901 | | 8/2008 |
| KR | 10-2010-0020987 | | 2/2010 |
| KR | 10-2010-0066172 | | 6/2010 |
| WO | 2013/068886 | | 5/2013 |

OTHER PUBLICATIONS

European Office Action dated Oct. 24, 2019 in corresponding European Patent Application No. 17890728.3.

International Search Report dated Mar. 6, 2018 in corresponding International Patent Application No. PCT/KR2017/012869 (3 pages).

Written Opinion of the International Searching Authority dated Mar. 6, 2018 in corresponding International Patent Application No. PCT/KR2017/012869 (10 pages).

Extended European Search Report dated Jan. 29, 2020 from European Application No. 17890728.3, 13 pages.

Communication pursuant to Article 94(3) EPC, dated Jul. 21, 2021, in corresponding European Patent Application No. 17890728.3 (5 pp.).

* cited by examiner

WASHING APPARATUS AND CONTROL METHOD THEREOF

CROSS-REFERENCE TO RELATED APPLICATIONS

This application is a U.S. National Stage Application which claims the benefit under 35 U.S.C. § 371 of International Patent Application No. PCT/KR2017/012869 filed on Nov. 14, 2017, which claims foreign priority benefit under 35 U.S.C. § 119 of Korean Patent Application No. 10-2017-0000863 filed on Jan. 3, 2017 in the Korean Intellectual Property Office, the contents of both of which are incorporated herein by reference.

TECHNICAL FIELD

The following embodiments relate to a washing apparatus and a control method of the washing apparatus. Specifically, the following embodiments relate to a washing apparatus and a control method of the washing apparatus that intuitively provide a user with the residual amount of a detergent (or softening agent) contained in a detergent case (or softening agent case) and the operation related to the supply of the detergent (or softening agent).

BACKGROUND ART

A washing apparatus refers to an electronic device that may wash laundry including clothes, bedding or towels, or other textile products using a detergent (or a cleaner). The washing apparatus includes a washing tub for receiving laundry and washing water, and may perform washing by the rotation of the washing tub by a motor and the relative motion of the laundry.

The washing apparatus may include a front loading type washing apparatus for washing laundry by relative movement between the laundry and the inner circumferential surface of the washing tub by rotating the washing tub disposed parallel (or inclined) to a bottom surface clockwise or counterclockwise with respect to a rotating shaft, and a top loading type washing apparatus for washing laundry using water currents generated by a pulsator when the washing tub disposed perpendicularly to a bottom surface and having the pulsator is rotated clockwise or counterclockwise with respect to a rotating shaft.

The washing apparatus may be provided with a supply assembly for supplying water mixed with washing water and detergent (or softening agent) into the washing tub.

DISCLOSURE

Technical Problem

A supply assembly of a washing apparatus that is easy to confirm the residual amount of a detergent (or the residual amount of a softening agent) and/or is easy to clean is required.

Technical Solution

An embodiment of the present disclosure provides a supply assembly including a detergent supply case to be inserted into or separated from a receiving portion of the main body of the washing apparatus and receive a detergent, a softening agent supply case to be inserted into or separated from a receiving portion of the main body of the washing apparatus and receive a softening agent, a detergent pump to supply a part of the detergent to a mixing tank, a softening agent pump to supply a part of the softening agent to the mixing tank, the mixing tank to receive at least one of the detergent and the softening agent and receive the washing water, a water supply unit to supply the washing water to the mixing tank, and a detergent dispenser connected to the mixing tank and including an outlet to receive at least one of a detergent-mixed water and a softening agent-mixed water from the mixing tank to discharge the at least one to the washing tub.

According to an aspect of the present disclosure, the detergent supply case may include a residual amount indicator positioned in the front thereof, and a remaining amount of the detergent received in the detergent supply case may be intuitively confirmed from the outside through the residual amount indicator.

According to an aspect of the present disclosure, the washing apparatus may further include a detergent light source, wherein the detergent light source may provide light to the detergent supply case.

According to an aspect of the present disclosure, the softening agent supply case may include a residual amount indicator positioned in the front thereof, and a remaining amount of the softening agent received in the softening agent supply case is intuitively confirmed from the outside through the residual amount indicator.

According to an aspect of the present disclosure, the washing apparatus may further include a softening agent light source, wherein the softening agent light source may provide light to the softening agent supply case.

According to an aspect of the present disclosure, the mixing tank may include an air inlet connected to a hose for supplying air at atmospheric pressure from the detergent dispenser.

According to an aspect of the present disclosure, the mixing tank may further include a siphon module to discharge the supplied detergent-mixed water to the detergent dispenser using a pressure difference.

According to an aspect of the present disclosure, the height of a bottom of the mixing tank may be higher than the height of an inlet of a siphon pipe of the siphon module.

According to an aspect of the present disclosure, the height of an outlet of the siphon pipe may be lower than the height of at least one of a detergent inlet of the mixing tank to which the detergent is supplied from the detergent pump, a the washing water inlet of the mixing tank to which the washing water is supplied from the washing water supply unit, and a softening agent inlet of the mixing tank to which the softening agent is supplied from the softening agent pump.

According to an aspect of the present disclosure, the washing apparatus may further include a mixing tank light source, wherein the mixing tank light source may provide light to the mixing tank.

Another embodiment of the present disclosure provides a washing apparatus including a main body, a door to open and close an upper portion of the main body by a hinge, a washing tub positioned inside the main body and receiving laundry, a supply assembly including a detergent supply case insert into or separated from a receiving portion of the main body of the washing apparatus and receiving a detergent, a softening agent supply case insert into or separated from a receiving portion of the main body of the washing apparatus and receiving a softening agent, a detergent pump to supply a part of the detergent to a mixing tank, a softening agent pump to supply a part of the softening agent to the mixing tank, the mixing tank to receive at least one of the detergent and the softening agent and receive the washing water, a water supply unit to supply the washing water to the mixing tank, and a detergent dispenser connected to the mixing tank and including an outlet to receive at least one of a detergent-mixed water and a softening agent-mixed water from the mixing tank to discharge the at least one to the washing tub, an input to receive the selection of a washing course, and a controller to control the pumps and the input, wherein the controller controls to generate the detergent-mixed water by calculating the weight of the laundry in response to a detection of the door close and a selected washing course, determining a detergent amount based on the calculated weight of the laundry, automatically supplying the detergent based on the determined detergent amount to the mixing tank by the driving of the detergent pump, and supplying the washing water to the mixing tank.

According to an aspect of the present disclosure, the controller may control to generate the softening agent-mixed water by calculating the weight of the laundry in response to a detection of the door close and a selected washing course, determining a softening agent amount based on the calculated weight of the laundry, automatically supplying the softening agent based on the determined softening agent amount to the mixing tank by the driving of the softening agent pump, and supplying the washing water to the mixing tank.

According to an aspect of the present disclosure, the washing apparatus may further include a plurality of light sources, wherein the plurality of light sources may include a detergent light source, a softening agent light source, and a mixing tank light source.

According to an aspect of the present disclosure, the controller may control the operation of the detergent light source based on the automatic supply of the detergent.

According to an aspect of the present disclosure, the controller may control the operation of the softening agent light source based on the automatic supply of the softening agent.

According to an aspect of the present disclosure, the controller may control the operation of the mixing tank light source based on the generation of the detergent-mixed water and the discharge of the detergent-mixed water in the mixing tank.

According to an aspect of the present disclosure, the controller may control the operation of the mixing tank light source based on the generation of the softening agent-mixed water and the discharge of the softening agent-mixed water in the mixing tank.

[Advantageous Effects]

The present disclosure can provide a washing apparatus and a control method of the washing apparatus in which the residual amount of a detergent in a detergent supply case installed on an upper portion of the washing apparatus may be intuitively confirmed.

The present disclosure can provide a washing apparatus and a control method of the washing apparatus in which the residual amount of a softening agent in a softening agent supply case installed on the upper portion of the washing apparatus may be intuitively confirmed.

The present disclosure can provide a washing apparatus and a control method of the washing apparatus in which the detergent supply case and a mixing tank for mixing the detergent and a washing water, which are mounted on the upper portion of the washing apparatus, are continuously arranged.

The present disclosure can provide a washing apparatus and a control method of the washing apparatus in which the softening agent supply case and the mixing tank for mixing the softening agent and the washing water, which are mounted on the upper portion of the washing apparatus, are continuously arranged.

The present disclosure can provide a washing apparatus and a control method of the washing apparatus in which whether or not a part of the detergent amount determined based on the weight of laundry is supplied to the mixing tank mounted on the upper portion of the washing apparatus may be intuitively confirmed.

The present disclosure can provide a washing apparatus and a control method of the washing apparatus in which whether or not a part of the softening agent amount determined based on the weight of laundry is supplied to the mixing tank mounted on the upper portion of the washing apparatus may be intuitively confirmed.

The present disclosure can provide a washing apparatus and a control method of the washing apparatus in which whether or not a detergent-mixed water or a softening agent-mixed water in the mixing tank mounted on the upper portion of the washing apparatus is discharged to a detergent dispenser may be intuitively confirmed.

Further, according to various embodiments of the present disclosure, the present disclosure can provide a washing apparatus and a control method of the washing apparatus in which the residual amount in the detergent supply case (or the softening agent case) may be intuitively confirmed using an internal light source.

MODE OF THE INVENTION

Hereinafter exemplary embodiments according to the present disclosure will be described in detail with reference to the accompanying drawings. Like reference numbers or signs in the respective drawings represent parts or components that perform substantially the same functions.

It will be understood that, although the terms first, second, etc. may be used herein to describe various components, these components should not be limited by these terms. These terms are only used to distinguish one component from another. For example, without departing from the scope of the present disclosure, the First component may be referred to as a second component, and similarly, the second component may also be referred to as a first component. The term "and/or" includes any combination of a plurality of related items or any one of a plurality of related items.

The terms used in the present specification are for the purpose of describing the embodiments and are not intended to restrict and/or to limit the present disclosure. For example, the singular expressions herein may include plural expressions, unless the context dearly dictates otherwise. Also, the terms "comprises" and has are intended to indicate that there are features, numbers, steps, operations, elements, parts, or combinations thereof described in the specification, and do not exclude the presence or addition of one or more other features, numbers, steps, operations, elements, parts, or combinations thereof.

Like reference numbers or signs in the respective drawings represent parts or components that perform substantially the same functions.

Hereinafter embodiments of the present disclosure will be described in detail with reference to the accompanying drawings.

Figure 1A:
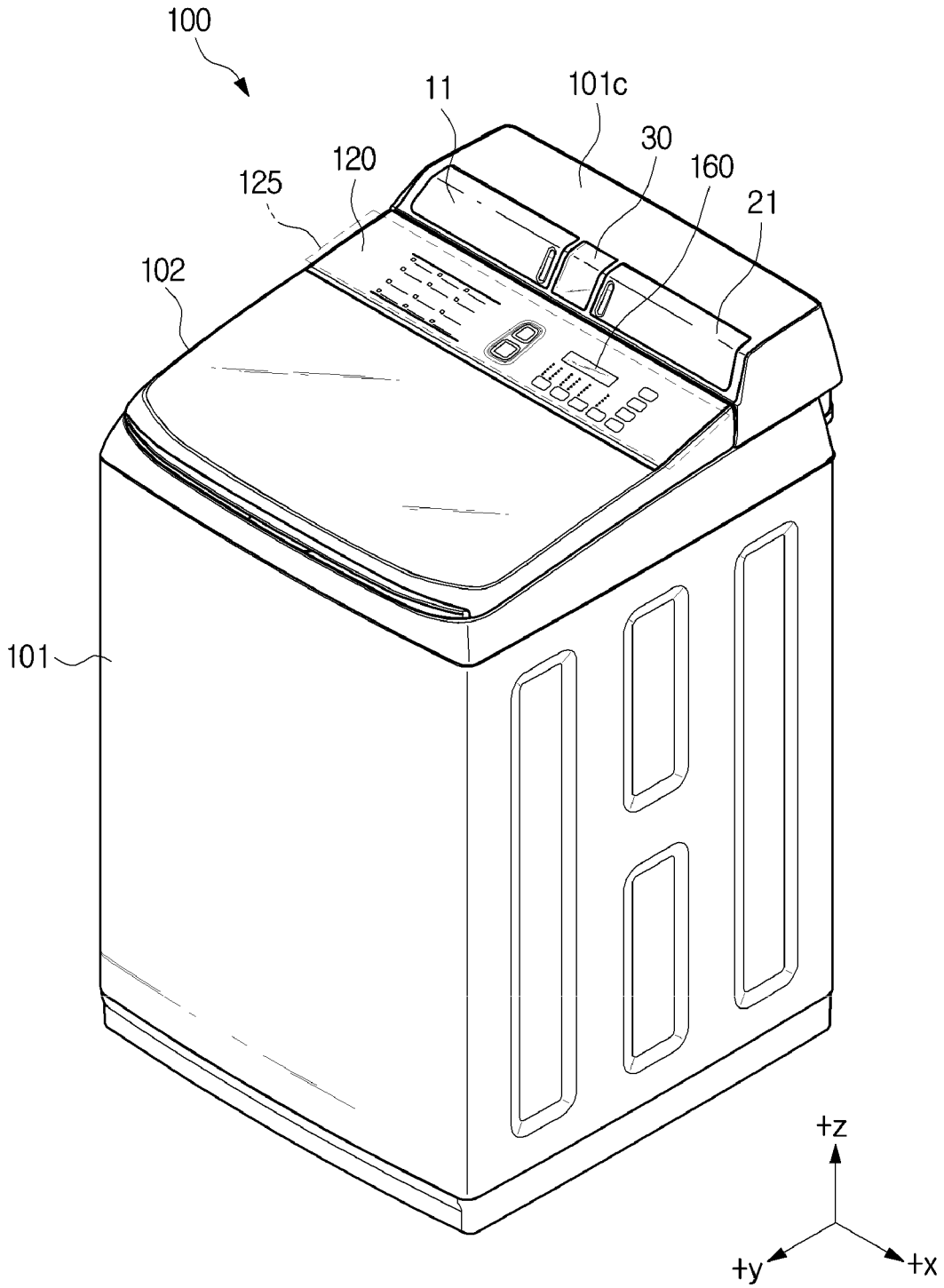
FIGS. 1*a* and 1*b* are schematic perspective views illustrating a washing apparatus according to an embodiment of the present disclosure.
Figure 1B:
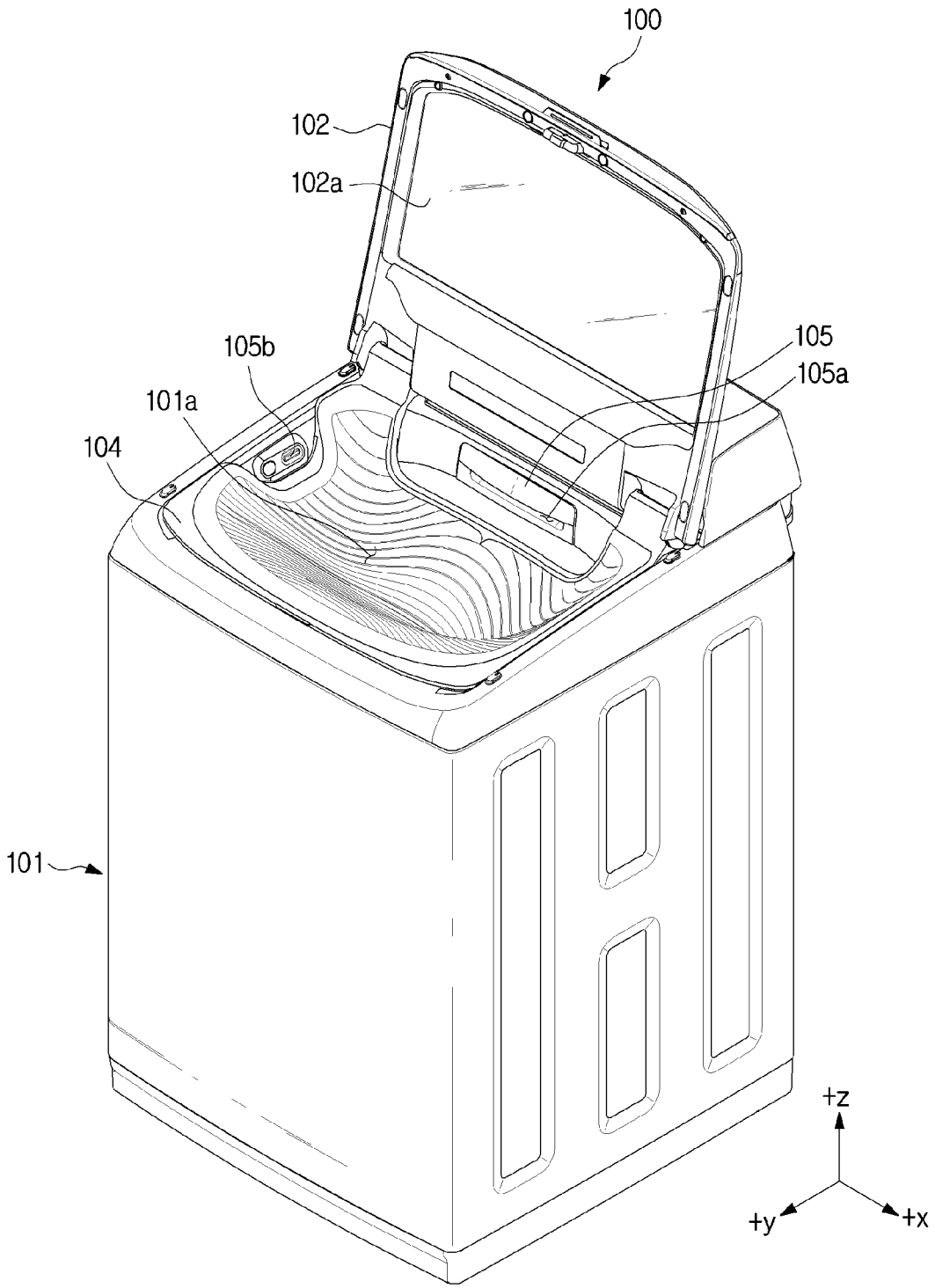

FIGS. 1*a* and 1*b* are schematic perspective views illustrating a washing apparatus according to an embodiment of the present disclosure.

Figure 2:
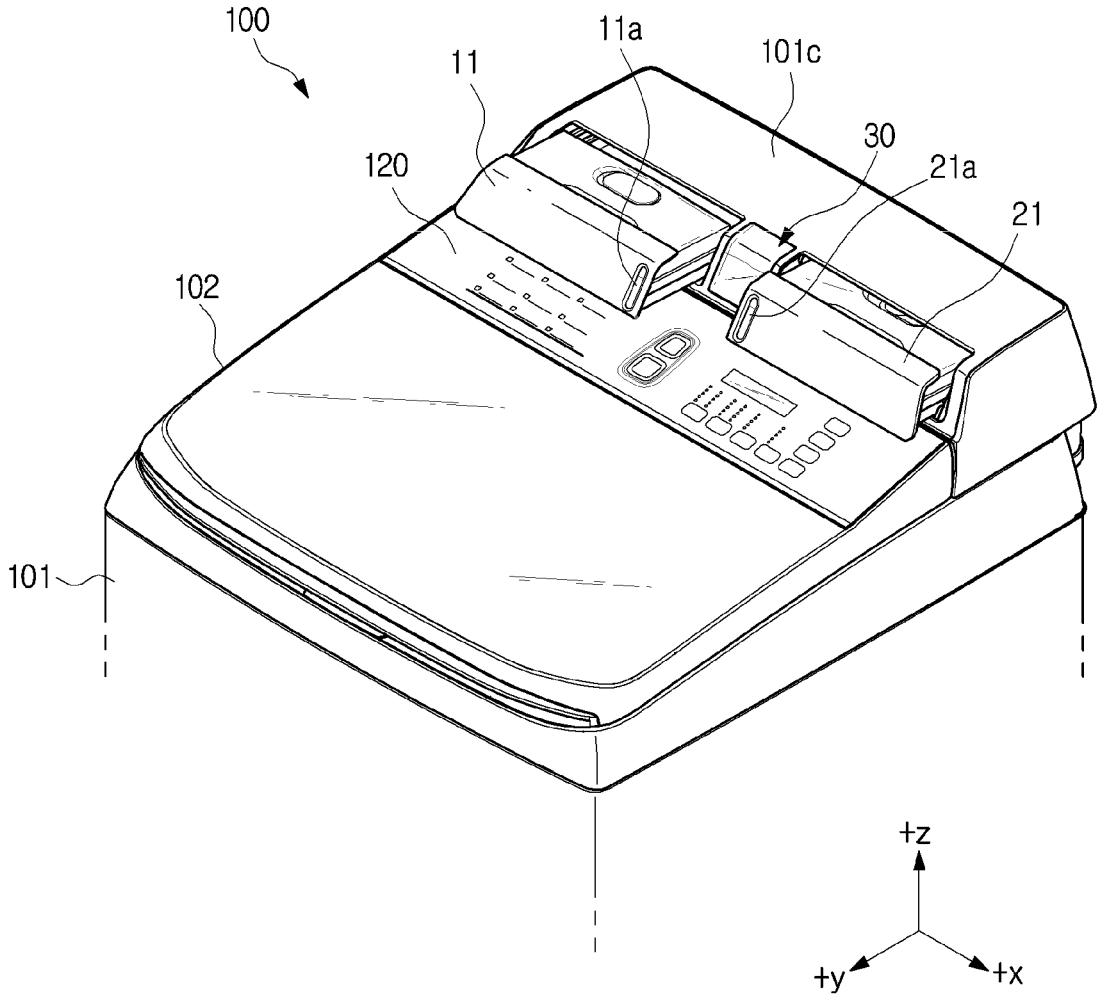
FIG. 2 is a schematic perspective view illustrating a detergent supply case, a softening agent supply case, and a mixing tank according to an embodiment of the present disclosure.

FIG. 2 is a schematic perspective view illustrating a detergent supply case, a softening agent supply case, and a mixing tank according to an embodiment of the present disclosure.

Referring to FIGS. 1 and 2, a washing apparatus 100 includes a main body 101 forming an outer appearance and a door 102 positioned on an upper portion 101*c* of the main body 101 and opened and closed by a hinge.

The main body 101 includes a fixed tub (not shown) for receiving the supplied washing water and a rotating tub (not shown) that rotates in a clockwise or counterclockwise direction inside the fixed tub (not shown). The fixed tub (not shown) and the rotating tub (not shown) may be referred to as a washing tub (not shown).

The washing apparatus 100 may include a water supply unit 140 (refer to FIG. 8) for supplying washing water (e.g., cold water, hot water) into the main body 101, a drawer type detergent supply case 11 for receiving a detergent, a drawer type softening agent supply case 21 for receiving a softening agent, and a mixing tank 30 for mixing the washing water supplied from the water supply unit 140 with the supplied detergent (or softening agent) and discharging the mixed water to the rotating tub (not shown).

The upper portion 101*c* (e.g., a portion of the upper portion is covered by the door 102 and a portion of the upper portion is not covered by a door 102) of the main body 101 may have an opening 101*a* for loading and unloading laundry. The opening 101*a* may be opened or closed by the door 102.

An input 120 including a plurality of operation buttons (e.g., a power button, an operation button, etc.) and a plurality of function buttons (e.g., washing course, option, etc.) and/or a display 160 for displaying the operation and status of the washing apparatus 100 may be positioned on an upper surface of the door 102. One of the input 120 and the display 160 may be positioned on the upper portion 100*c* of the main body 101. The input 120 and the display 160 may be referred to as an operation panel (OPE).

The fixed tub (not shown) is installed inside the main body 101, the rotating tub (not shown) is installed inside the fixed tub (not shown), and a pulsator (not shown) for generating water currents is installed in a lower portion of the inside of the rotating tub (not shown).

A motor 170 for driving the rotating tub (not shown) and the pulsator (not shown), and a drainage unit 180 for discharging washing water contaminated by being used for washing to the outside may be positioned below the fixed tub (not shown) (e.g., a lower end portion of the main body 101).

The washing apparatus 100 may perform washing through the pulsator (not shown) that causes laundry loaded in the rotating tub (not shown), the detergent (or detergent and softening agent) and washing water to be rotated by the driving force of the motor 170.

The washing apparatus 100 that is washing may perform rinsing of laundry through repeated supply of washing water (or supply of washing water and supply of a softening agent) and drainage of contaminated washing water. When the rinsing is completed, the washing apparatus 100 may drain the contaminated washing water (or the washing water) through the drainage unit 180. When the drainage is completed, the washing apparatus 100 may rotate the rotating tub (not shown) at a high speed to dehydrate the washing water remaining in the laundry.

A door sensor (or a door switch) 153 for detecting the opening and closing of the door 102 may be positioned on the upper portion of the main body 101. The door sensor 530 may be positioned on the door 102. A plurality of the door sensor 530 may be provided (e.g., one of the door sensors may be provided in the front of the door 102 (e.g., +y-axis direction) and the remainder may be provided in the rear of the door 102 adjacent to a hinge 101*b* (e.g., −y-axis direction)).

The detergent supply case 11 for receiving the detergent, the softening agent supply case 21 for receiving the softening agent, and the mixing tank 30 for mixing the detergent (or the softening agent) and washing water may be positioned on the upper portion 101*c* of the main body 101. A partial area 11*a* of the front surface (e.g., the +y-axis direction) of the detergent supply case 11 to be drawn out may be transparent. A partial area 21*a* of the front surface (e.g., the +y-axis direction) of the softening agent supply case 21 to be drawn out may be transparent. A partial area of the front surface (e.g., the +y-axis direction or a +z-axis direction) of the mixing tank 30 may be transparent.

A detergent dispenser 105 including an outlet 105*a* for discharging a detergent-mixed water and/or a softening agent-mixed water to the rotating tub (not shown) may be portioned on the upper portion of the main body 101 (e.g., below the door 102 and above the washing tub 103). The washing water supplied from the water supply unit 140 may be discharged through the outlet 105*a* of the detergent dispenser 105.

The door 102 may include a door glass 102*a* occupying a partial area thereof. The door glass 102*a* may include a transparent material (e.g., acrylic, plastic, glass, or the like) enabling the inside of the body 101 to be seen through.

An additional door 104 for hand washing or rough washing separately from washing through the washing tub (not shown) may be positioned below the door 102 and above the main body 101. In a washing apparatus including the additional door 104, the additional door 104 may be referred to as a second door, and the door 102 may be referred to as a first door. The washing apparatus including the additional door 104 may include an additional water supply port 105*b* for supplying the additional door 104 with washing water.

Figure 3:
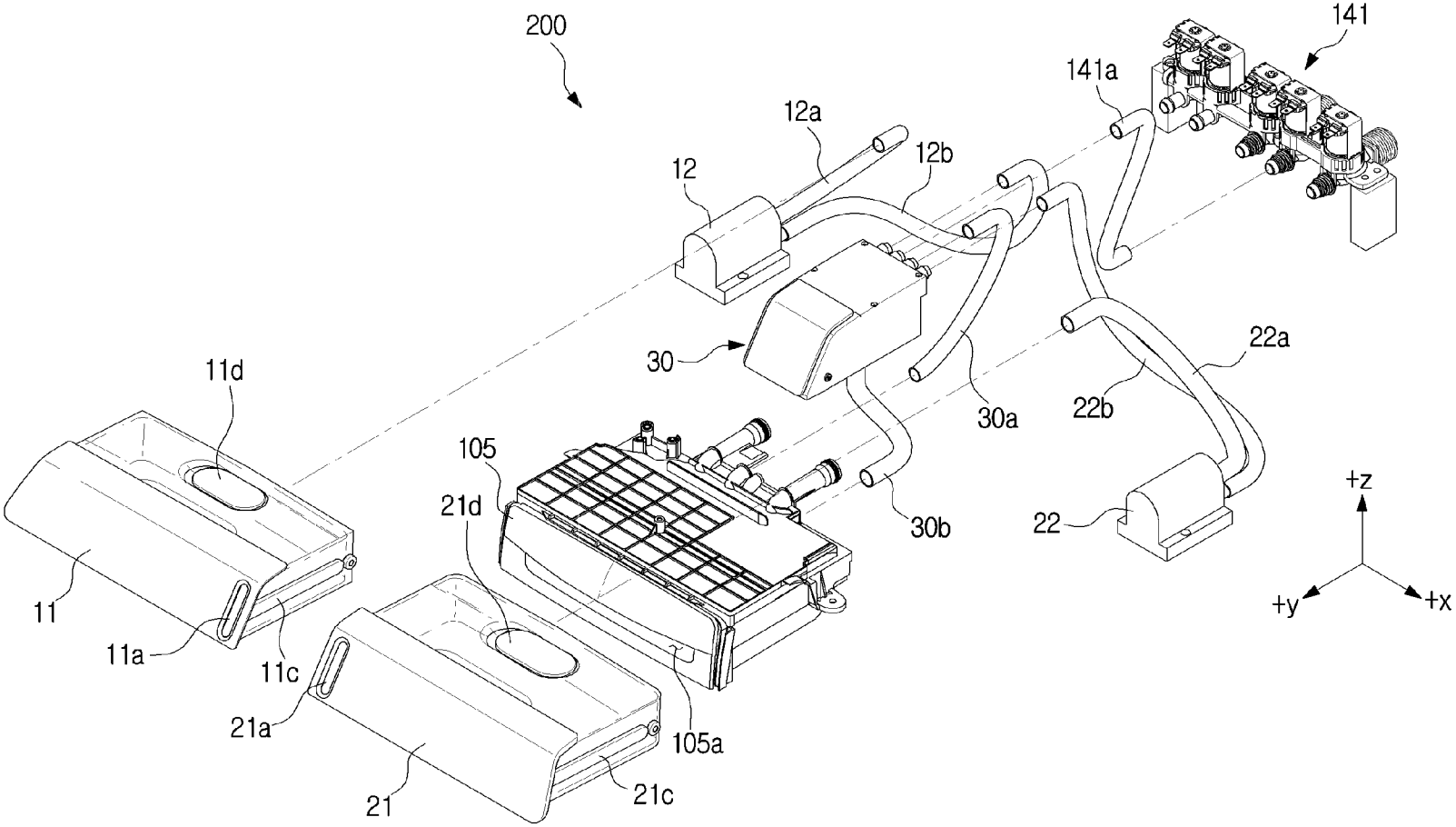
FIG. 3 is a schematic exploded perspective view illustrating a supply assembly according to an embodiment of the present disclosure.

FIG. 3 is a schematic exploded perspective view illustrating a supply assembly according to an embodiment of the present disclosure.

Figure 4A:
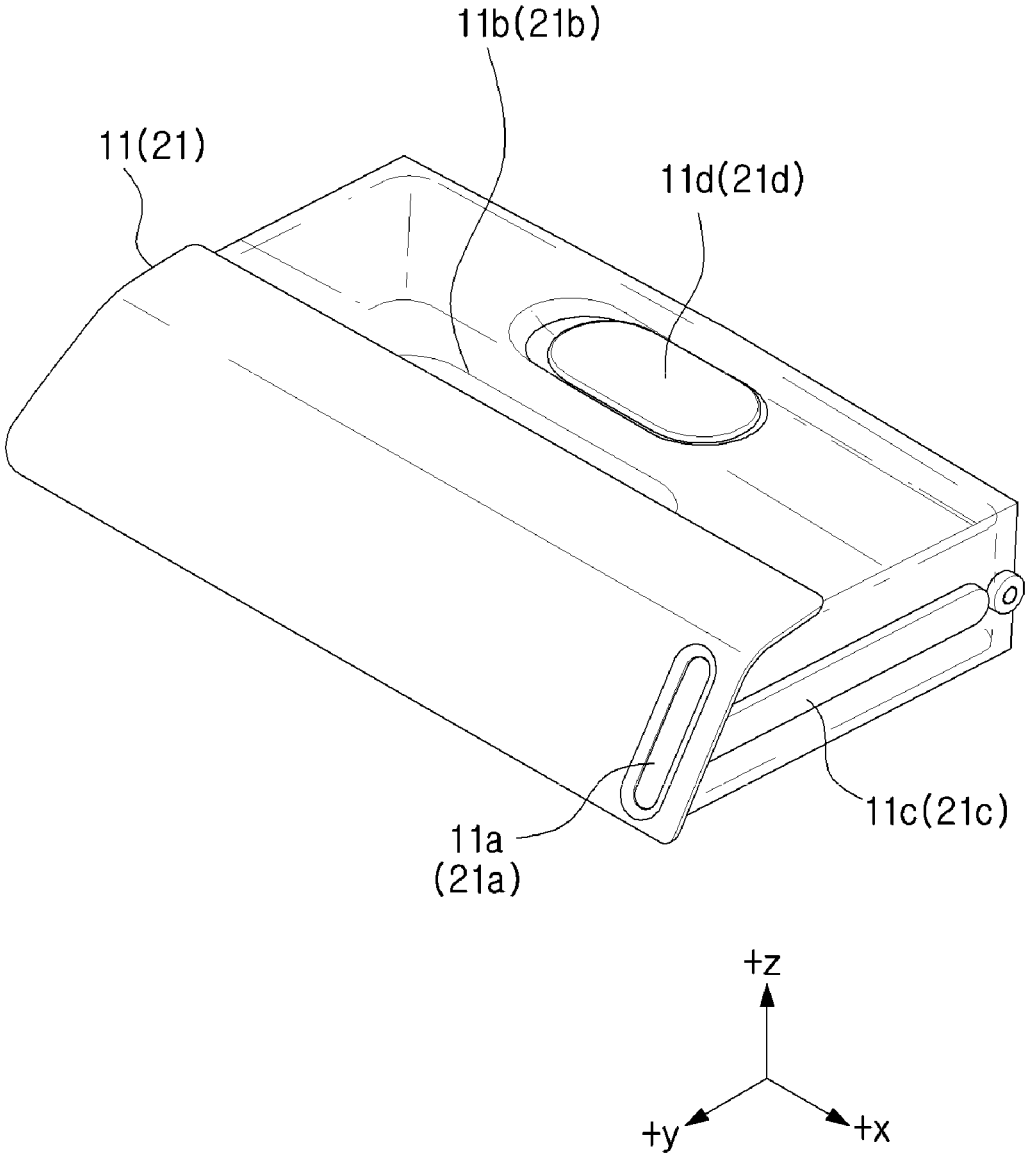
FIGS. 4A and 4B are a schematic front perspective view and a schematic rear perspective view illustrating the detergent supply case (the softening agent supply case) according to an embodiment of the present disclosure.
Figure 4B:
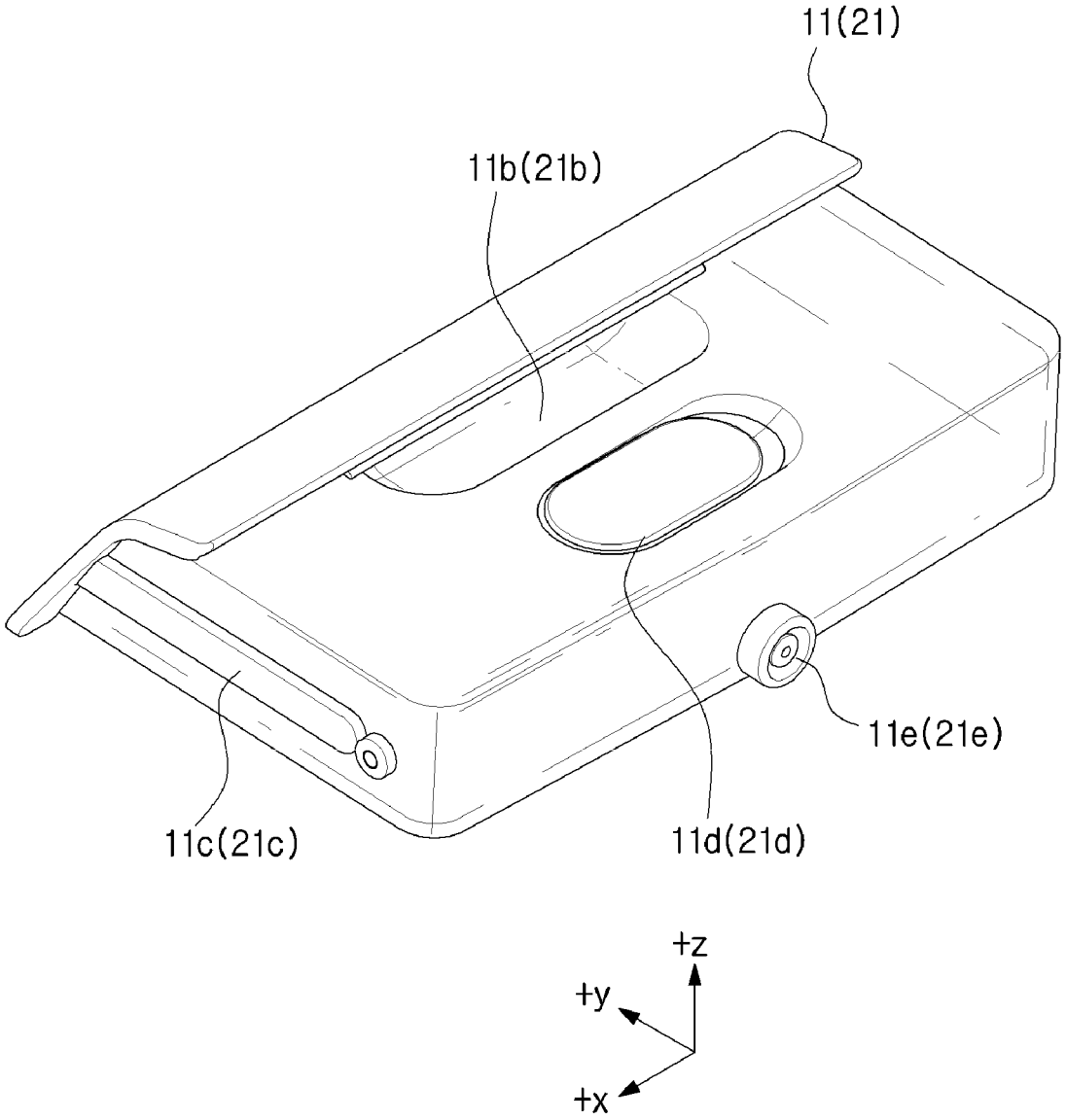

FIGS. 4A and 4B are a schematic front perspective view and a schematic rear perspective view illustrating the detergent supply case (the softening agent supply case) according to an embodiment of the present disclosure.

Referring to FIGS. 3 to 4B, a supply assembly 200 is provided for supplying detergent mixed water and softening agent mixed water to the washing tub (not shown), respectively. Also, the supply assembly 200 may be provided to supply the detergent and the softening agent to the washing tub (not shown), respectively.

The supply assembly 200 may include the detergent supply case 11, the softening agent supply case 21, and the mixing tank 30. The supply assembly 200 may include the detergent supply case 11 and the mixing tank 30. The supply assembly 200 may further include a drawer type bleaching agent supply case (not shown) for receiving a bleaching agent. One of the detergent supply case 11 and the softening agent supply case 21 may be changed to the bleaching agent supply case (not shown).

The supply assembly 200 may include the detergent supply case 11, a detergent pump 12, detergent hoses 12*a* and 12*b*, softening agent hoses 22*a* and 22*b*, the softening agent supply case 21, a softening agent pump 22, the mixing tank 30, an air hose 30*a*, a discharge hose 30*b*, a water supply unit 141, a water supply hose 141*a*, and the detergent dispenser 105. The components of the supply assembly 200 described above may be added, deleted, or changed.

The difference between the detergent supply case 11 and the softening agent supply case 21 may be the difference between the detergent and the softening agent that are contained therein. The present embodiment will be described based on a detergent supply unit 10, and the description of the detergent supply unit 10 may be applied to a corresponding softening agent supply unit 20 equally.

The detergent supply case 11 may be accommodated in (e.g., may be inserted into or separated from) a detergent receiving portion 101*d*1 (refer to FIG. 7) positioned on the upper portion 101*c* of the main body 101. The detergent supply case 11 is accommodated in (or may be mounted on and demounted from) the detergent receiving portion 101*d*1 using protrusions 11*c* protruding from opposite sides of the detergent supply case 11 and guides 101*e*1 provided on opposite sides of the detergent receiving portion 101*d*1.

The detergent supply case 11 for receiving the detergent may include a residual amount indicator 11*a* for confirming the residual amount of detergent (or detergent amount) from outside, a groove 11*b* that may be grasped by a user, the protrusions 11*c* formed on the opposite sides of the detergent supply case 11, a cap 11*d* corresponding to a detergent replenishing hole (not shown), and a detergent outlet 11*e* positioned at a rear portion of the detergent supply case 11.

The detergent supply case 11 may include a transparent material (e.g., acrylic, plastic, glass, or the like). Also, a portion (e.g., the front surface) of the detergent supply case 11 may have an opaque color (e.g., a color similar to the color painted on the main body of the washing apparatus).

The shape of the detergent supply case 11 may be a hexahedron, a hexahedron having one side inclined, or a polyhedron including an octahedron.

The detergent contained in the detergent supply case 11 may be supplied to the mixing tank 30 through the detergent pump 12, the detergent hose 12*a* connected to the detergent outlet 11*e*, and the detergent hose 12*b* connected to the detergent pump 12. The detergent pump 12 may be operated by the control of a controller 110. The detergent pump 12 may operate to be correspond to the detergent supply amount determined by the control of the controller 110. The detergent pump 12 may be positioned below the detergent supply case 11 (e.g., in a −z-axis direction).

The softening agent supply case 21 may be accommodated in (e.g., may be inserted into or separated from) a softening agent receiving portion 101*d*2 (refer to FIG. 7) positioned on the upper portion 101*c* of the main body 101. The softening agent supply case 21 may be accommodated in (or may be mounted in and demounted from) the softening agent receiving portion 101*d*2 using protrusions 21*c* protruding from opposite sides of the softening agent supply case 21 and guides 101*e*2 provided on opposite sides of the softening agent receiving portion 101*d*2.

The softening agent supply case 21 for receiving the softening agent may include a residual amount indicator 21*a* for confirming the residual amount of softening agent softening agent (or softening agent amount) from the outside, a groove 21*b* that may be grasped by the user, the protrusions 21*c* formed on the opposite sides of the softening agent supply case 21, a cap 21*d* corresponding to a softening agent replenishing hole (not shown), and a softening agent outlet 21*e* positioned at a rear portion of the softening agent supply case 21.

The softening agent supply case 21 may include a transparent material (e.g., acrylic, plastic, glass, or the like). Also, a portion (e.g., the front surface) of the softening agent supply case 21 may have an opaque color (e.g., a color similar to the color painted on the main body of the washing apparatus).

The shape of the softening agent supply case 21 may be a hexahedron, a hexahedron having one surface inclined, or a polyhedron including an octahedron.

The softening agent contained in the softening agent supply case 21 may be supplied to the mixing tank 30 through the softening agent pump 22, the softening agent hose 22*a* connected to the softening agent outlet 21*e*, and the softening agent hose 22*b* connected to the softening agent pump 22. The softening agent pump 22 may be operated by the control of the controller 110. The softening agent pump 22 may operate to be correspond to the softening agent supply amount determined by the control of the controller 110. The softening agent pump 22 may be positioned below the softening agent supply case 21 (e.g., the −z-axis direction).

The mixing tank 30 may discharge the detergent-mixed water mixed with the detergent supplied from the detergent supply case 11 and the washing water supplied from the water supply unit 141 to the detergent dispenser 105 through the discharge hose 30*b* using the principle of a siphon. The air hose 30*a* may be coupled to the mixing tank 30 to maintain the pressure inside the mixing tank 30 at atmospheric pressure. The mixing tank 30 may also discharge the softening agent-mixed water mixed with the softening agent supplied from the softening agent supply case 21 and the washing water supplied from the water supply unit 141 to the detergent dispenser 105 through the discharge hose 30*b* using the principle of a siphon.

The mixing tank 30 may discharge the detergent-mixed water and the softening agent-mixed water sequentially to the detergent dispenser 105 so that detergent-mixed water and the softening agent-mixed water are divided. For example, the mixing tank 30 may discharge the detergent-mixed water to the detergent dispenser 105 first, and then may discharge the softening agent-mixed water to the detergent dispenser 105. The mixing tank 30 may also discharge the detergent-mixed water and the softening agent-mixed water that are mixed to the detergent dispenser 105.

The mixing tank 30 may be implemented such that the entire surfaces are made of a transparent material, one surface (e.g., the front surface in the +y-axis direction) of the entire surfaces is made of a transparent material, or two surfaces (e.g., the front surface (or a portion of the front surface) in the +y-axis direction and the upper surface in the +z-axis direction (or a portion of the upper surface)) of the entire surfaces are made of a transparent material.

The mixing tank 30 may be positioned between the detergent supply case 11 and the softening agent supply case 21. The detergent supply case 11 may be positioned on one side (e.g., the −x axis direction) with respect to the mixing tank 30. In addition, the softening agent supply case 21 may be positioned on the other side (e.g., the +x axis direction) with respect to the mixing tank 30. The front surface of the mixing tank 30, a portion of the front surface of the detergent supply case 11, and a portion of the front surface of the softening agent supply case 21 may be implemented with a transparent material.

The detergent dispenser 105, which includes the outlet 105*a* for discharging the detergent-mixed water and the softening agent-mixed water discharged from the mixing tank 30 to the washing tub (not shown), may be positioned below the mixing tank 30. The detergent-mixed water and the softening agent-mixed water may be discharged to the washing tub (not shown) through the outlet 105*a* of the detergent dispenser 105.

Figure 5A:
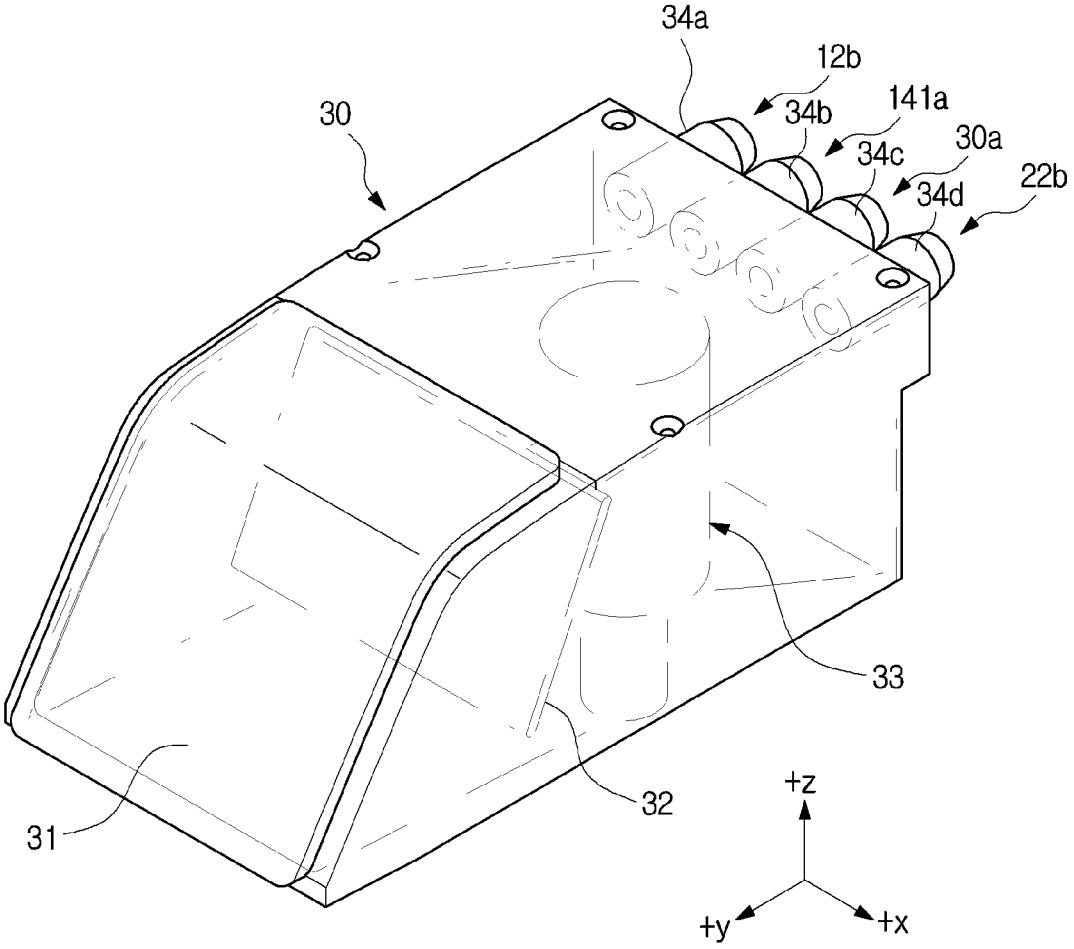
FIGS. 5A and 5B are a schematic perspective view and a schematic cross-sectional view illustrating the mixing tank according to an embodiment of the present disclosure.
Figure 5B:
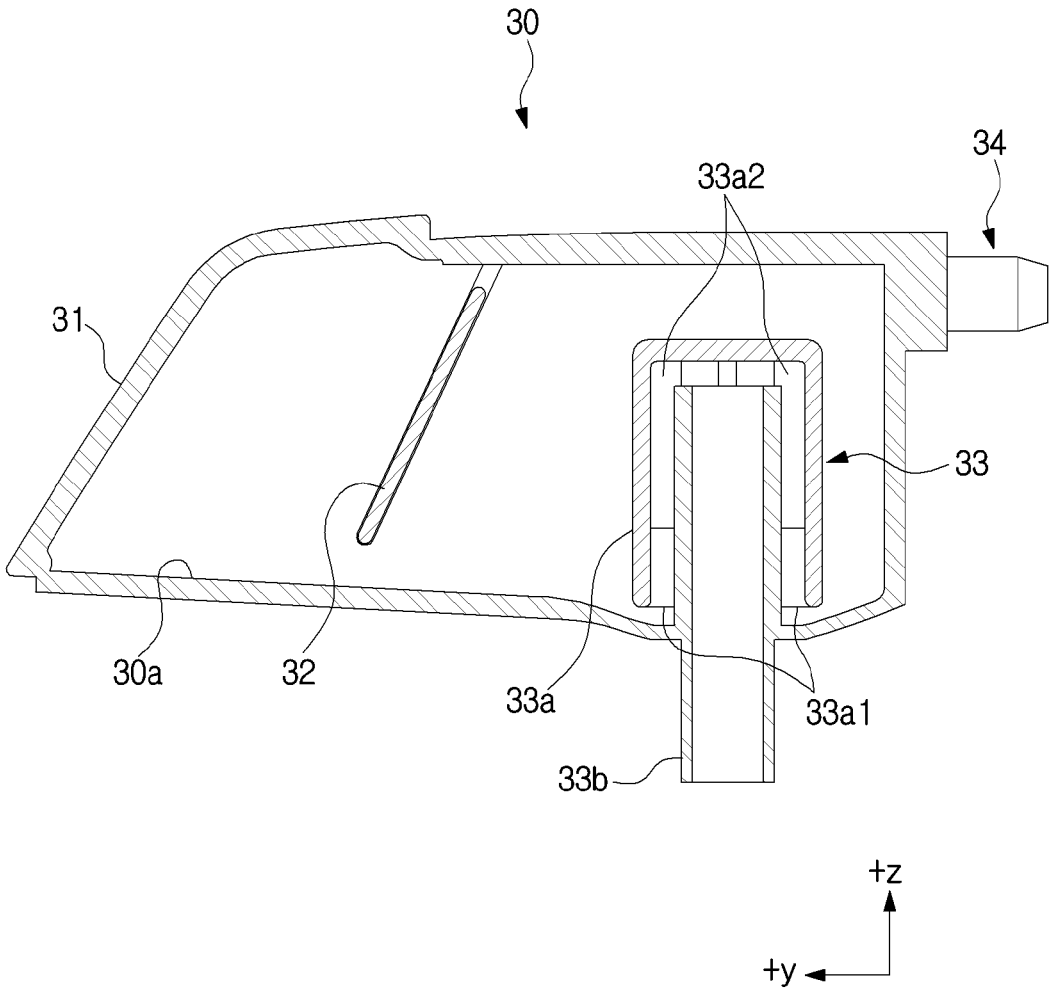

FIGS. 5A and 5B are a schematic perspective view and a schematic cross-sectional view illustrating the mixing tank according to an embodiment of the present disclosure.

FIGS. 6A to 6D are schematic views illustrating a discharge process of mixed water in the mixing tank according to an embodiment of the present disclosure.

Referring to FIGS. 5A to 6D, the mixing tank 30 may include a window 31, a back plate 32, a siphon module 33, and a plurality of inlets 34. A bottom 30*a* of the mixing tank 30 is inclined toward the siphon module 33.

The height of the inclined bottom 30*a* of the mixing tank 30 may be higher than the height of an inlet 33*a*1 of the siphon module 33. The height of the bottom 30*a* of the mixing tank 30 adjacent to the inlet 33*a*1 of the siphon module 33 may be lower than the height of the inlet 33*a*1 of the siphon module 33. The height of the bottom 30*a* of the mixing tank 30 may be lower than the height of an outlet 33*a*2 of the siphon module 33. The height of the outlet 33*a*2 of the siphon module 33 may be lower than the height of the inlets 34.

The window 31 may be implemented on one of a portion of the front surface, the entire front surface, a portion of the upper surface, the entire front surface and a portion of the upper surface, a portion of the front surface and a portion of the upper surface, a portion of the front surface and the entire upper surface of the mixing tank 30. The window 31 may be implemented with a transparent material (e.g., acrylic, plastic, glass, or the like).

The back plate 32 may make the mixing of the detergent and washing water that is being injected and the mixing of the softening agent and washing water that is being injected uniform. The back plate 32 may make the discharge of the detergent-mixed water into the detergent dispenser 105 and the discharge of the softening agent-mixed water into the detergent dispenser 105 uniform. The back plate 32 may prevent external exposure of the detergent, the softening agent and the washing water that are being injected. The back plate 32 may reduce the exhaust noise of the detergent-mixed water and the softening agent-mixed water which are discharged into the detergent dispenser 105.

The siphon module 33 may include a siphon pipe 33*a* and a siphon drain 33*b*. The siphon module 33 may move at least one of the detergent-mixed water and the softening agent-mixed water in the mixing tank 30 positioned at a relatively high position to the detergent dispenser 105 positioned at a relatively low position using a pressure difference.

Figure 6A:
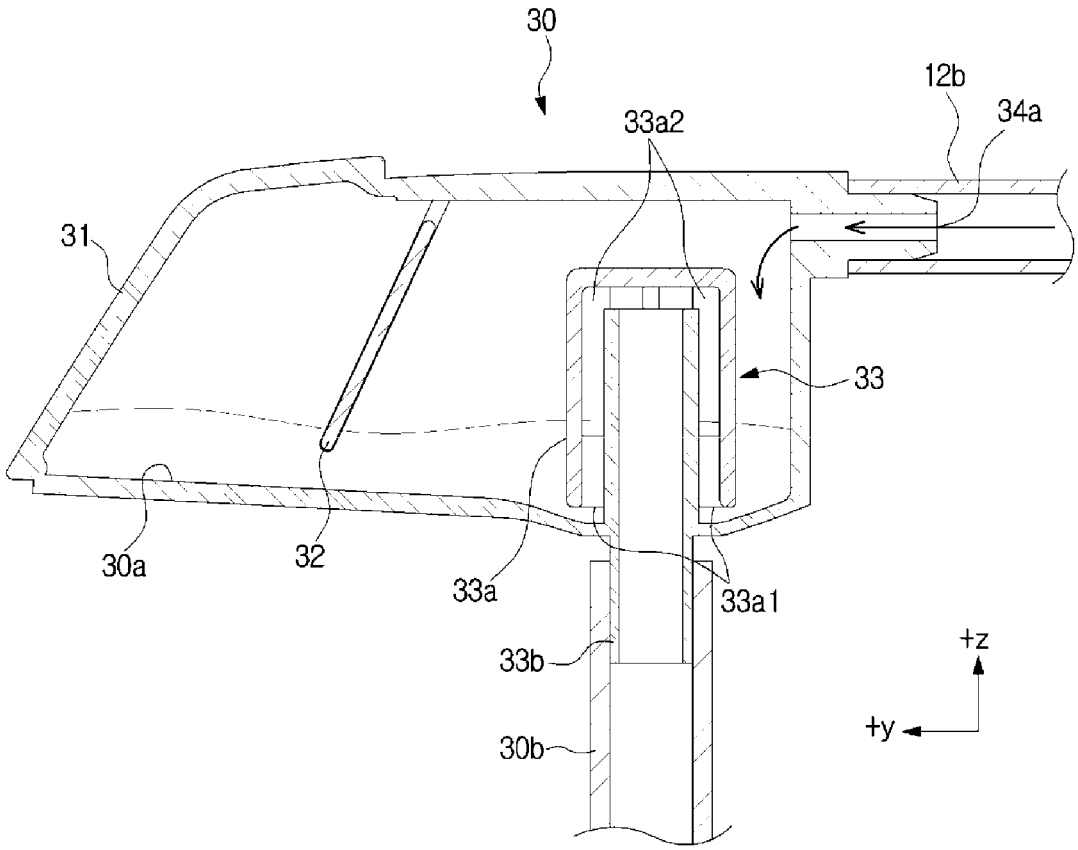
FIGS. 6A to 6D are schematic views illustrating a discharge process of mixed water in the mixing tank according to an embodiment of the present disclosure.

In FIG. 6A, the detergent pumped from the detergent pump 12 may be injected into the mixing tank 30 through an inlet 34*a*. The detergent pump 12 may supply the detergent to the mixing tank 30 under the control of the controller 110. The supplied detergent may be introduced into the siphon pipe 33*a* through the inlet 33*a*1 of the siphon pipe 33*a*.

The user may confirm whether or not the detergent is supplied through the window 31 of the mixing tank 30. The user may confirm the amount of the detergent that is being injected through the window 31 of the mixing tank 30. Also, the user may confirm the water level of the detergent through the window 31 of the mixing tank 30.

Figure 6B:
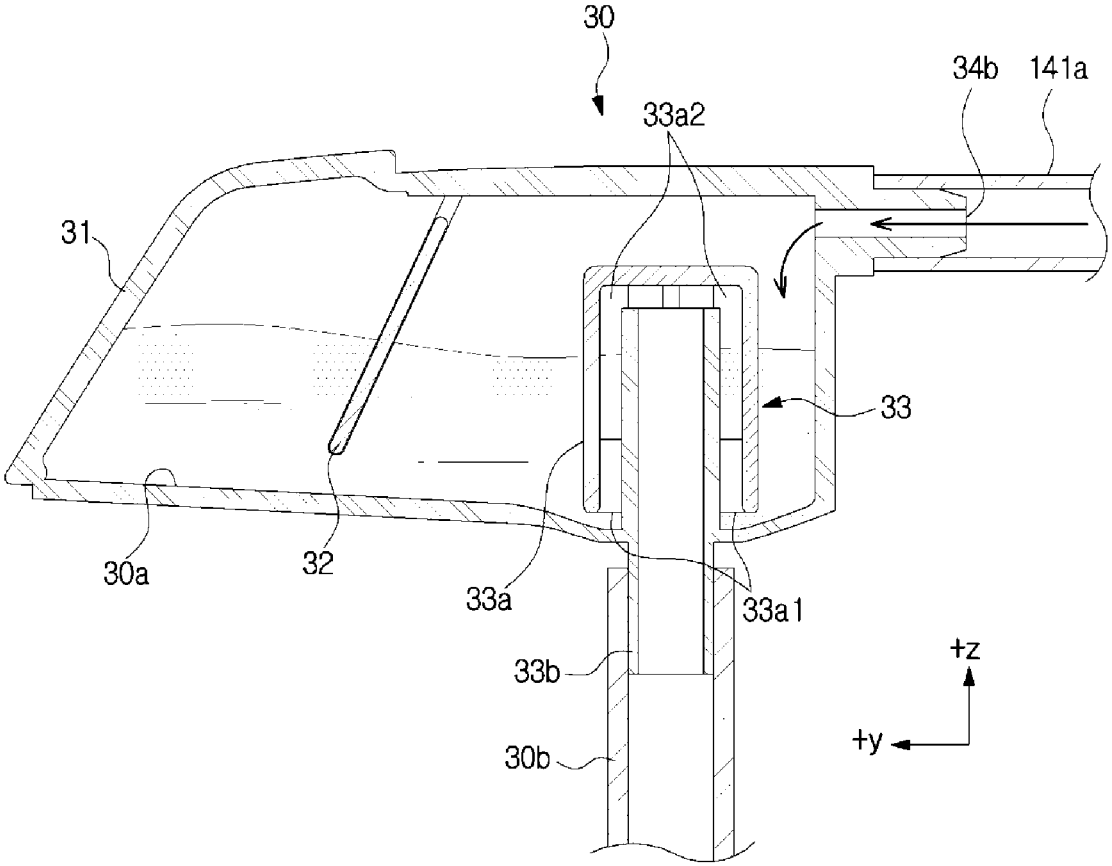

In FIG. 6B, the washing water supplied from the water supply unit 141 may be injected into the mixing tank 30 receiving the detergent through an inlet 34*b*.

The detergent may be diluted (e.g., detergent-mixed water) by the washing water that is being injected. The water supply unit 141 may supply the washing water to the mixing tank 30 under the control of the controller 110. The supplied detergent may be introduced into the siphon pipe 33*a* through the inlet 33*a*1 of the siphon pipe 33*a*. The supplied washing water may be introduced into the siphon pipe 33*a* through the inlet 33*a*1 of the siphon pipe 33*a*. Also, the diluted detergent-mixed water may be introduced into the siphon pipe 33*a* through the inlet 33*a*1 of the siphon pipe 33*a*.

The user may confirm whether or not the washing water is supplied (or whether or not the detergent-mixed water is generated) through the window 31 of the mixing tank 30. The user may confirm the amount of the washing water that is being injected through the window 31 of the mixing tank 30. Also, the user may confirm the water level of the detergent-mixed water through the window 31 of the mixing tank 30.

Figure 6C:
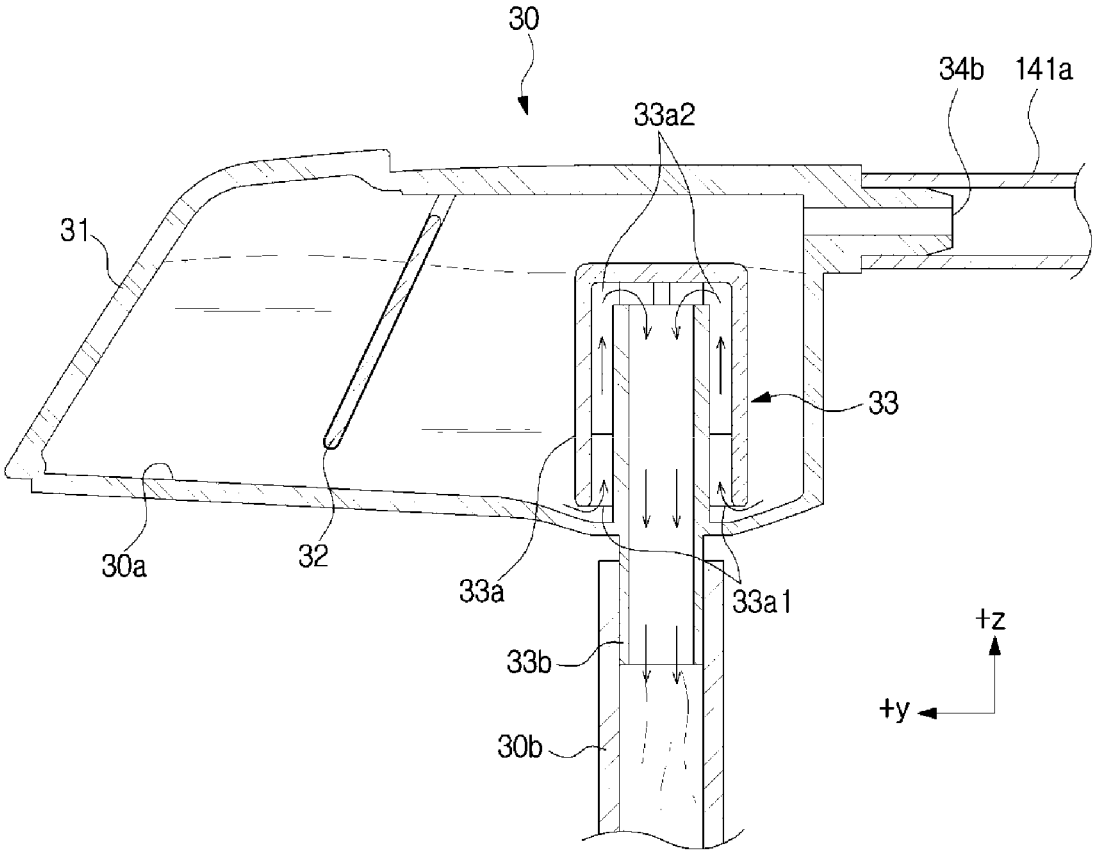
Figure 6D:
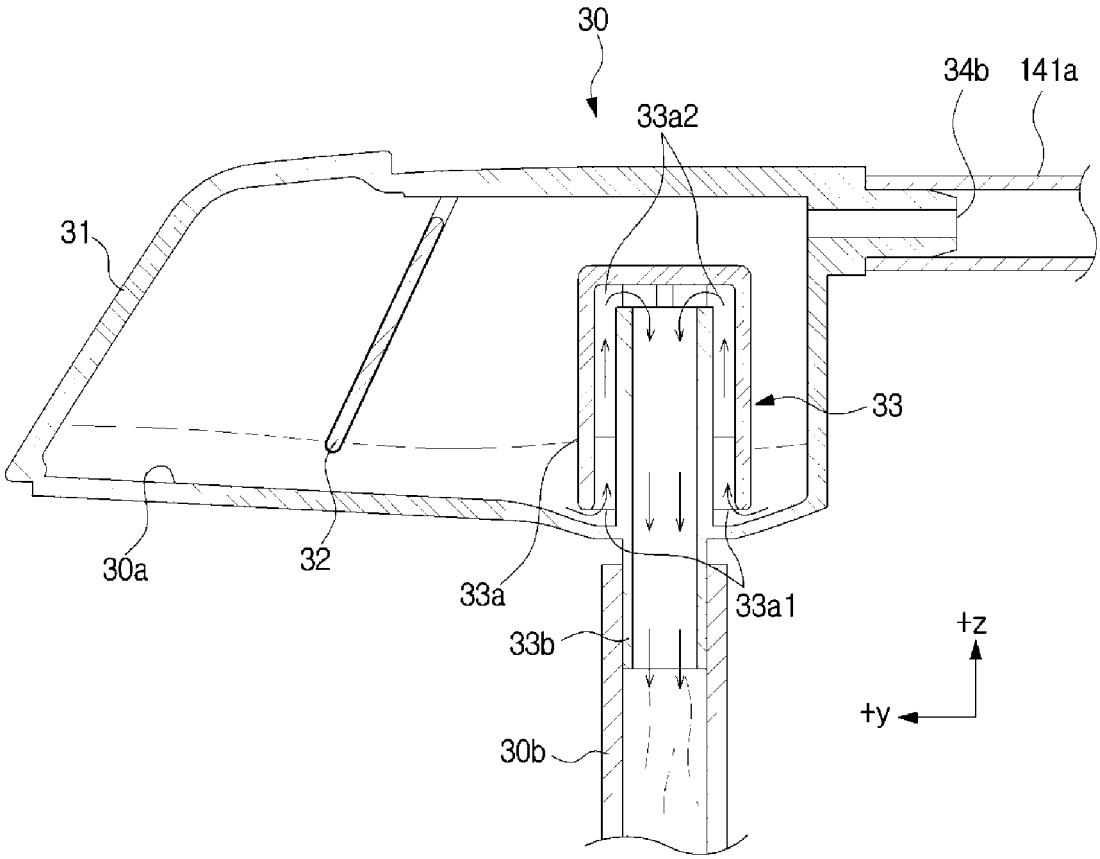

In FIGS. 6C and 6D, the water level of the detergent-mixed water becomes high and may reach the outlet 33*a*2 of the siphon pipe 33*a*. Atmospheric pressure air may be injected into the mixing tank 30 through the air hose 30*a*. The inside of the mixing tank 30 may be maintained at atmospheric pressure by the injected air. In addition, backflow into the hoses 12*b* and 22*b* by the detergent-mixed water may be prevented by the injected air. The injection of air may also be carried out in the process shown in FIGS. 6A and 6B.

The detergent-mixed water reaching the outlet 33*a*2 of the siphon pipe 33*a* may be discharged to the siphon drain 33*b* by the principle of the siphon. The detergent-mixed water may be discharged to the detergent dispenser 105 through the discharge hose 30*b* coupled to the siphon drain 33*b*. The water level in the mixing tank 30 and the water level in the siphon pipe 33*a* may be lowered together by the discharge of the detergent-mixed water through the siphon drain 33*b*.

The process shown in FIGS. 6A to 6D may be repeated depending on the amount of the detergent supplied to the washing tub (or the amount of the detergent-mixed water).

The washing water may be supplied to the mixing tank 30 by the control of the controller 110 even after the detergent-mixed water is discharged. The detergent-mixed water remaining in the mixing tank 30 may be discharged to the detergent dispenser 105 by the supplied washing water.

The discharge of the softening agent-mixed water will be described with reference to FIGS. 6A to 6D.

In FIG. 6A, the softening agent pumped from the softening agent pump 22 may be injected into the mixing tank 30 through an inlet 34*d* in the process of rinsing the laundry after washing. The softening agent pump 22 may supply the softening agent to the mixing tank 30 under the control of the controller 110. The supplied softening agent may be introduced into the siphon pipe 33*a* through the inlet 33*a*1 of the siphon pipe 33*a*.

The user may confirm whether or not the softening agent is supplied through the window 31 of the mixing tank 30. The user may confirm the amount of the softening agent that is being injected through the window 31 of the mixing tank 30. Also, the user may confirm the water level of the softening agent through the window 31 of the mixing tank 30.

In FIG. 6B, the washing water supplied from the water supply unit 141 may be injected into the mixing tank 30 receiving the softening agent through an inlet 34*b*.

The softening agent may be diluted (e.g., softening agent-mixed water) by the washing water that is being injected. The water supply unit 141 may supply the washing water to the mixing tank 30 under the control of the controller 110. The supplied softening agent may be introduced into the siphon pipe 33*a* through the inlet 33*a*1 of the siphon pipe 33*a*. The supplied washing water may be introduced into the siphon pipe 33*a* through the inlet 33*a*1 of the siphon pipe 33*a*. Also, the diluted softening agent-mixed water may be introduced into the siphon pipe 33*a* through the inlet 33*a*1 of the siphon pipe 33*a*.

The user may confirm whether or not the washing water is supplied (or whether or not the softening agent-mixed water is generated) through the window 31 of the mixing tank 30. The user may confirm the amount of the washing water that is being injected through the window 31 of the mixing tank 30. Also, the user may confirm the water level of the softening agent-mixed water through the window 31 of the mixing tank 30.

In FIGS. 6C and 6D, the water level of the softening agent-mixed water becomes high and may reach the outlet 33*a*2 of the siphon pipe 33*a*. Atmospheric pressure air may be injected into the mixing tank 30 through the air hose 30*a*. The inside of the mixing tank 30 may be maintained at atmospheric pressure by the injected air. In addition, backflow into the hoses 12*b* and 22*b* by the softening agent-mixed water may be prevented by the injected air. The injection of air may also be carried out in the process shown in FIGS. 6A and 6B.

The softening agent-mixed water reaching the outlet 33*a*2 of the siphon pipe 33*a* may be discharged to the siphon drain 33*b* by the principle of the siphon. The softening agent-mixed water may be discharged to the detergent dispenser 105 through the discharge hose 30*b* coupled to the siphon drain 33*b*. The water level in the mixing tank 30 and the water level in the siphon pipe 33*a* may be lowered together by the discharge of the softening agent-mixed water through the siphon drain 33*b*.

The process shown in FIGS. 6A to 6D may be repeated depending on the amount of the softening agent supplied to the washing tub (or the amount of the softening agent-mixed water).

The washing water may be supplied to the mixing tank 30 by the control of the controller 110 even after the softening agent-mixed water is discharged. The softening agent-mixed water remaining in the mixing tank 30 may be discharged to the detergent dispenser 105 by the supplied washing water.

Figure 7:
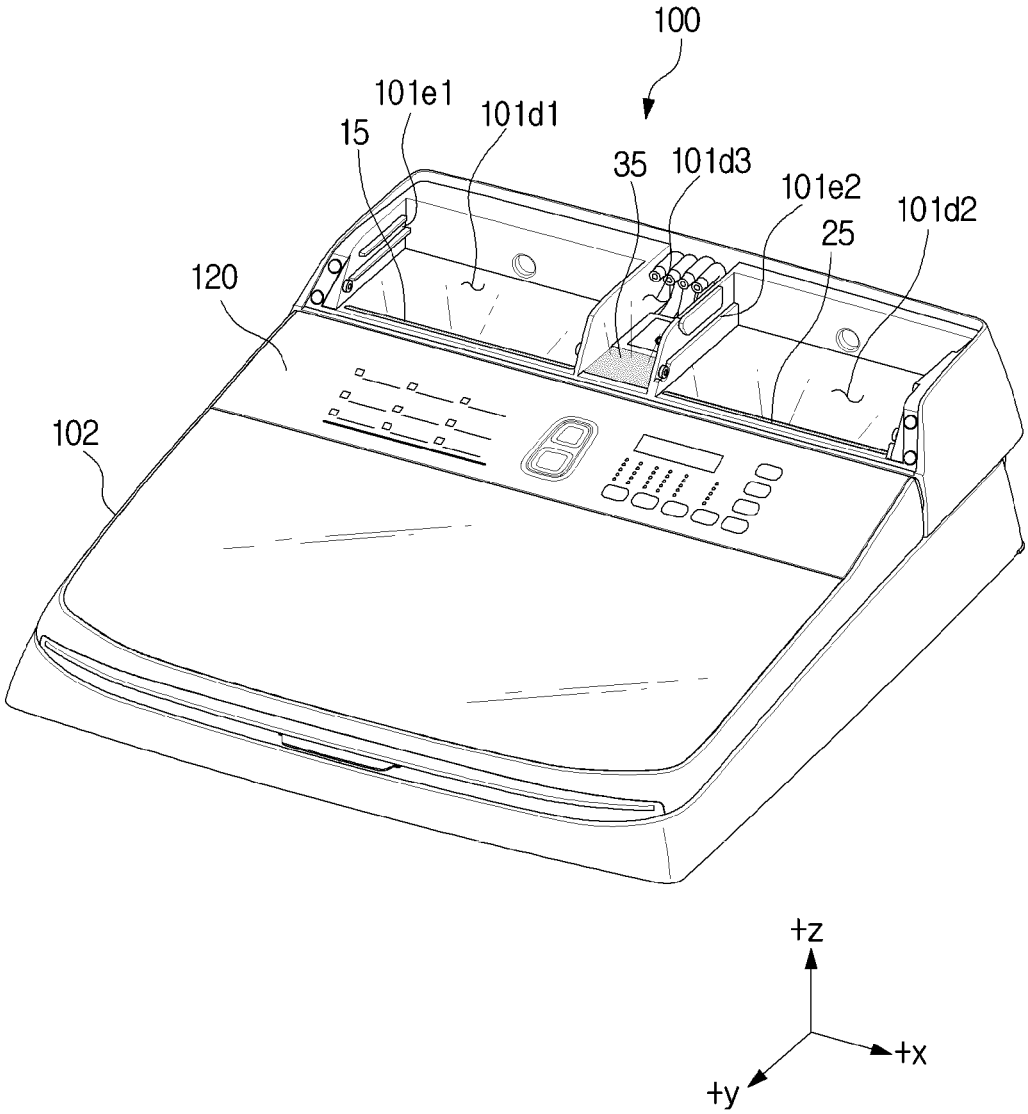
FIG. 7 is a schematic view illustrating a plurality of light sources according to an embodiment of the present disclosure.

FIG. 7 is a schematic view illustrating a plurality of light sources according to an embodiment of the present disclosure.

Referring to FIG. 7, the washing apparatus 100 may include a plurality of light sources. The plurality of light sources may include a detergent light source 15 for providing light to the detergent supply case 11 (refer to FIG. 2), a softening agent light source 25 for providing light to the softening agent supply case 21 (refer to FIG. 2), and a mixing tank light source 35 for providing light to the mixing tank 30.

The light sources 15 and 25 may be positioned in the front of the receiving portions 101*d*1 and 101*d*2 (e.g., the +y-axis direction or an upper portion of the main body 101). The light sources 15 and 25 may be positioned below the residual amount indicators 11*a* and 21*a* to correspond to the residual amount indicators 11*a* and 21*a*.

The light source 35 may be positioned in the front of the receiving portion 101*d*3 (e.g., the +y-axis direction or an upper portion of the main body 101). The light source 35 may be positioned to correspond to the window 31 of the mixing tank 30.

The plurality of light sources may be implemented to be separated from each other based on the detergent light source 15, the softening agent light source 25, and the mixing tank light source 25. The light sources 15, 25, and 35 may be independently operated (e.g., power on/off or blinking) by the control of the controller 110. The light sources 15, 25, and 35 may include LEDs.

The above-described light sources 15, 25, and 35 may be implemented as one light source (integrally connected light source). When one light source is provided, the length of the one light source may be shorter than the sum of the length of the detergent light source 15, the length of the softening agent light source 25, and the length of the mixing tank light source 35. The length of the one light source may be longer than 30% of the sum of the length of the detergent light source 15, the length of the softening agent light source 25, and the length of the mixing tank light source 35.

The light sources 15, 25, and 35 may operate in at least one case of a case where the power of the washing apparatus 100 is turned on, a case where the motor 170 (refer to FIG. 8) is driven based on the washing course received by the washing apparatus 100, a case where the weight of laundry is calculated in the washing apparatus 100, a case where the amount of the detergent is calculated based on the weight of the laundry calculated in the washing apparatus 100, and a case where the amount of the softening agent is determined based on the weight of the laundry calculated in the washing apparatus 100.

The controller 110 may control to operate (e.g., turn on) the above-described light sources (one of the light sources 15, 25, and 35, or a combination of the light sources 15, 25, and 35) in at least one case of a case where the power of the washing apparatus 100 is turned on, a case where the motor 170 is driven based on the washing course received by the washing apparatus 100, a case where the weight of laundry is calculated in the washing apparatus 100, a case where the amount of the detergent is calculated based on the weight of the laundry calculated in the washing apparatus 100, a case where the amount of the softening agent is determined based on the weight of the laundry calculated in the washing apparatus 100, a case where the detergent motor is driven based on the calculated detergent amount, and a case where the softening agent motor is driven based on the calculated softening agent amount.

Figure 8:
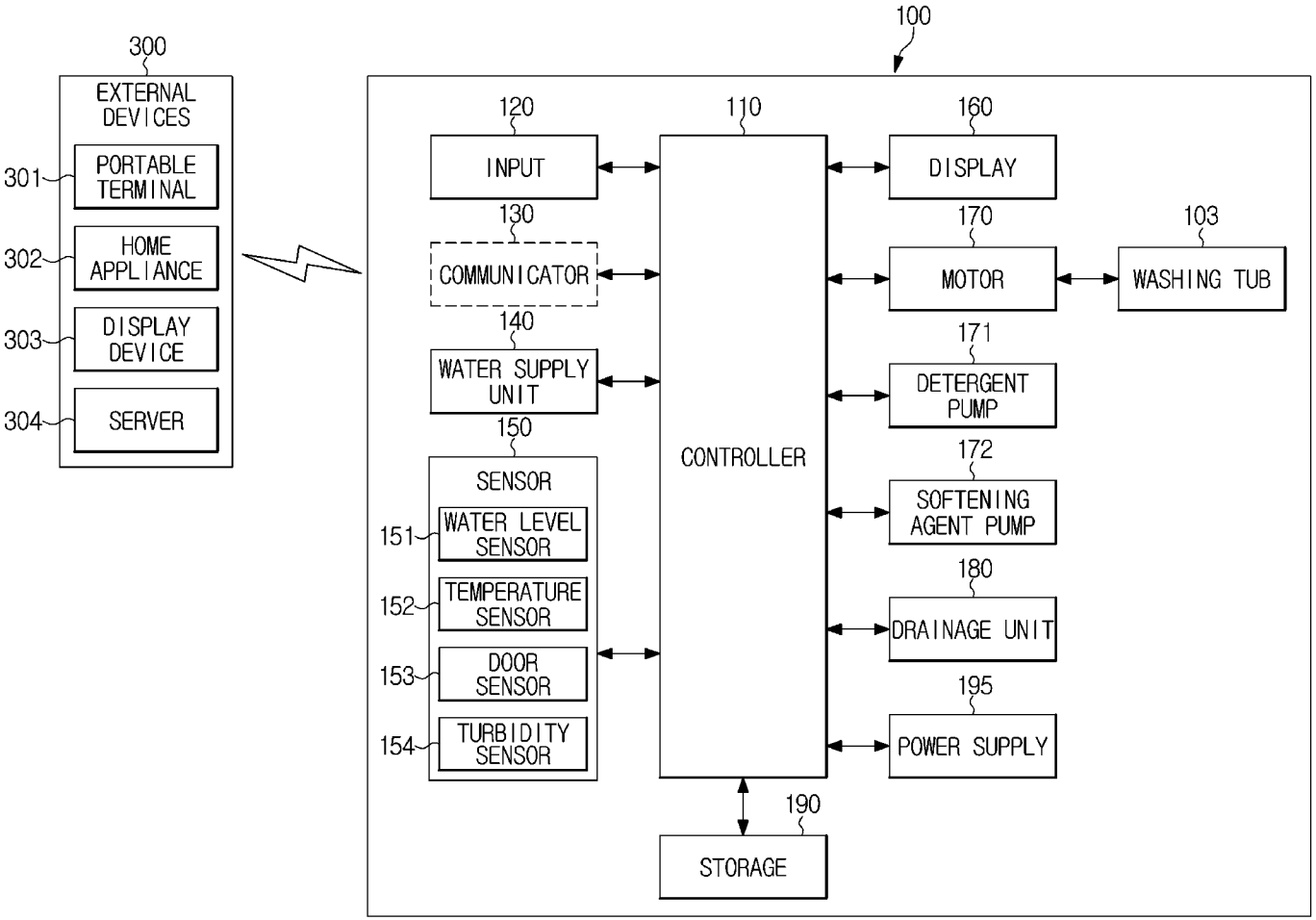
FIG. 8 is a schematic block diagram illustrating the washing apparatus according to an embodiment of the present disclosure.

FIG. 8 is a schematic block diagram illustrating the washing apparatus according to an embodiment of the present disclosure.

Referring to FIG. 8, the washing apparatus 100 may be functionally connected to external devices 300 using a communicator 130. The external devices 300 may include a portable terminal 301 including a smart phone, a home appliance 302 including a refrigerator, a display device 303 including a TV, or a server 304.

Through the communicator 130, the washing apparatus 100 may transmit operation (e.g., washing course or option) information of the washing apparatus or state (e.g., normal or abnormal) information of the washing apparatus to the external device or may receive control information (e.g., a control command corresponding to the power on/off of the washing apparatus) from the outside.

The washing apparatus 100 may include the controller 110, the input 120, the communicator 130, the water supply unit 140, a sensor 150, the display 160, the motor 170, pumps 171 and 172, the drainage unit 180, a storage 190, and a power supply 195.

The controller 110 may control the operation of the washing apparatus 100. The controller 110 may include a processor (not shown). The controller 110 may also include a ROM (not shown) in which a control program for controlling the washing apparatus 100 is stored and a RAM (not shown) used as a storage area for control information received from the outside of the washing apparatus 100, operation information of the washing apparatus 100, or state information of the washing apparatus 100.

The controller 110 may control the operation of the pumps 171 and 172. For example, the controller 110 may output an electric signal corresponding to the operation (e.g., operation, stop, or power on/off) of the pump 171 to the pump 171 in order to supply the detergent from the detergent supply case 11. The controller 110 may output an electric signal corresponding to the operation (e.g., operation, stop, or power on/off) of the pump 172 to the pump 172 in order to supply the softening agent from the softening agent supply case 21. The controller 110 may control the operation of the water supply unit 141.

The controller 110 may control the operation of the washing apparatus 100 and the signal flow between the internal components 120 to 190 and process the data. The controller 110 may collect operation information of the washing apparatus 100 and detect the state of the washing apparatus 100 using the sensor 150. The controller 110 may control the power supply to the internal components 110 to 195 using the power supply 195.

The processor (not shown), the ROM (not shown), and the RAM (not shown) may be connected to each other. The processor (not shown), the ROM (not shown), and the RAM (not shown) may be implemented in a built-in or SOC (system on chip) form.

The controller 110 may control the input 120, the communicator 130, the water supply unit 140, the sensor 150, the display 160, the motor 170, the pumps 171 and 172, the drainage unit 180, the storage 190, and the power supply 195.

The term 'controller of the washing apparatus' may be referred to as including the processor (not shown), the ROM (not shown), and the RAM (not shown). Further, the term 'controller of the washing apparatus' may mean the processor.

The input 120 may receive a user input (e.g., power on/off, operation, washing course, or option). The input 120 may output an electrical signal corresponding to the received user input to the controller 110. The input 120 may be positioned on an upper portion of the door 102 or the upper portion 101*c* of the main body 101.

The communicator 130 may be connected to the external devices 300 or a network through a communication network using one or more antennas by the control of the controller 110. The communicator 130 may transmit operation (e.g., washing course or option) information of the washing apparatus or status (e.g., normal or abnormal) information of the washing apparatus to the outside under the control of the controller 110. Further, the communicator 130 may receive control information (e.g., a control command corresponding to the power on/off of the washing apparatus) from the outside under the control of the controller 110.

The communicator 130 may include a wireless LAN communicator, a local communicator, or a mobile communicator. The wireless LAN communicator may support, for example, a Wi-Fi communication. The local communicator may include, for example, a Bluetooth communication, a Bluetooth low energy communication, an IrDA (infrared data association), an UWB (ultra-wideband) communication, and/or a NFC communication. The mobile communicator may be connected to the external devices 300 through a mobile communication network using one or more antennas by the control of the controller 110.

The water supply unit 140 may supply washing water to the washing tub (not shown) or the additional door 104 under the control of the controller 110. The water supply unit 140 may supply washing water to the mixing tank 30. The water supply unit 140 may supply washing water to the additional door 104 and the mixing tank 30.

The sensor 150 may detect the operation and/or state of the washing apparatus 100. The sensor 150 may output an electrical signal corresponding to the detected operation and/or state of the washing apparatus 100 to the controller 110.

A water level sensor 151 may detect the level of the washing water (or detergent-mixed water, softening agent-mixed water, water mixed with the detergent and the softening agent, and water mixed with the detergent, the softening agent, and the bleaching agent) contained in the washing tub (not shown). The water level sensor 151 may include an electric water level sensor or a mechanical water level sensor.

A temperature sensor 152 may detect the temperature of the washing water supplied through the water supply unit 141.

The door sensor 153 may detect whether the door 102 is open or closed.

A turbidity sensor 154 may calculate the contamination degree of the washing water (or detergent-mixed water, softening agent-mixed water, water mixed with the detergent and the softening agent, and water mixed with the detergent, the softening agent, and the bleaching agent) of the washing tub (not shown). The type of the sensor 150 described above may be added, deleted or changed depending on the performance and structure of the washing apparatus 100.

The display 160 may display the operation and the state of the washing apparatus 100.

The motor 170 may provide a driving force. The motor 170 may rotate the washing tub (not shown) and the pulsator (not shown) under the control of the controller 110.

The detergent pump 171 may supply the detergent from the detergent supply case 11 to the mixing tank 30 under the control of the controller 110. The softening agent pump 172 may supply the softening agent from the softening agent supply case 21 to the mixing tank 30 under the control of the controller 110.

The drainage unit 180 may discharge contaminated washing water (or washing water) in the washing tub (not shown) to the outside of the washing apparatus 100.

The storage 190 may store signals or data input/output corresponding to the operation (or state) of the components 110 to 195 under the control of the controller 110. The storage 190 may store a control program for controlling the washing apparatus 100 or the controller 110. The storage 190 may store control information received from the external devices 300, information corresponding to an electrical signal received from the input 120, information corresponding to an electrical signal received from the sensor 150, operation information of the washing apparatus 100, state information of the washing apparatus 100, and the like.

The power supply 195 may supply power to the components 110 to 195 of the washing apparatus 100 under the control of the controller 110.

It will be easily understood by those skilled in the art that at least one of the components 110 to 195 of the washing apparatus 100 illustrated in FIG. 8 may be added, deleted or changed in accordance with the performance of the washing apparatus 100.

Figure 9:
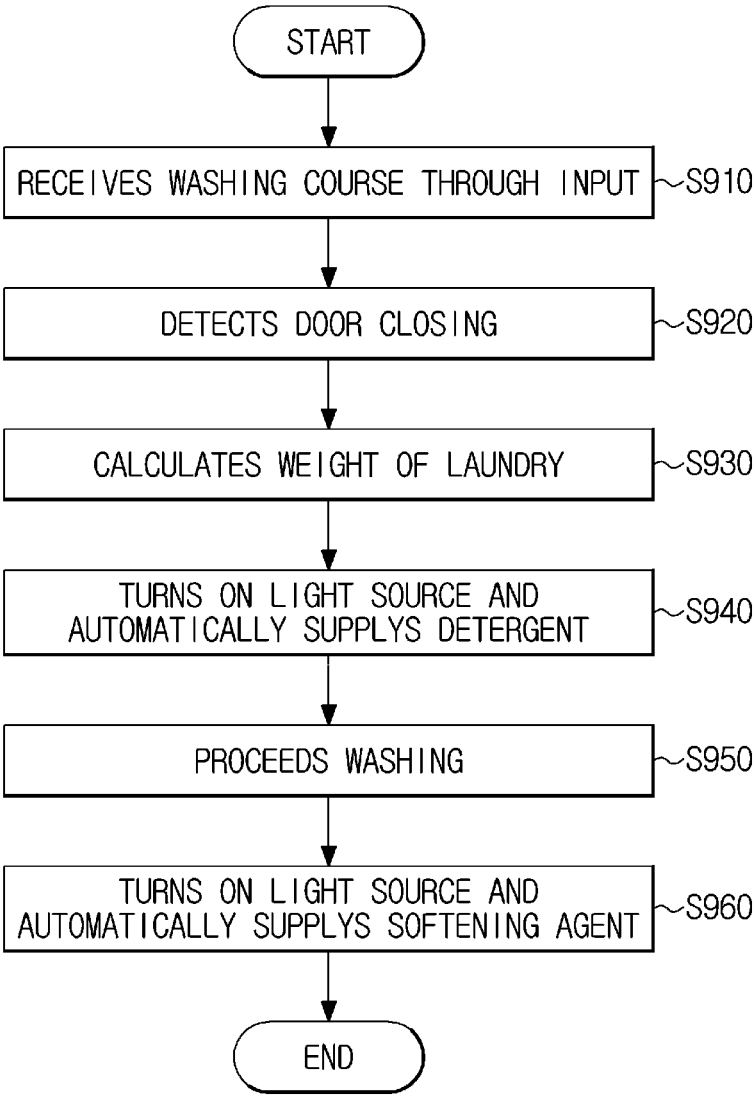
FIG. 9 is a flowchart illustrating a method of controlling the washing apparatus according to an embodiment of the present disclosure.

FIG. 9 is a flowchart illustrating a method of controlling the washing apparatus according to an embodiment of the present disclosure.

In operation S910 of FIG. 9, the washing course selected through the input is received.

The user loads the laundry into the washing tub (not shown) through the opening 101*a* (refer to FIG. 1*b*). The user closes the door 102 and selects (or presses) the power button of the input 120. The user selects a washing course (e.g., a baby clothes course) through the input 120. The controller 110 may control the display 160 to display visual information corresponding to the selected washing course.

In operation S920 of FIG. 9, door closing is detected.

When the door 102 is closed, the door sensor 153 may output an electrical signal corresponding to the door closing to the controller 110. The controller 110 may detect the closing of the door 102 using the electrical signal received by the door sensor 153.

In operation S930 of FIG. 9, the weight of the laundry is calculated.

The controller 110 may drive the motor 170 to rotate the washing tub (not shown) that contains the laundry. Before the washing water is supplied, the controller 110 may drive the motor 170 to rotate the washing tub (not shown) that contains the laundry. The controller 110 may calculate the weight using at least one of the feedback current value of the motor 170, the height of the laundry of the washing tub (not shown), and the rotating speed of the rotating tub (not shown). Because the calculation of the weight of the laundry is a known technique, a detailed description thereof will be omitted. The calculated weight may be stored in the storage 190.

In operation S940 of FIG. 9, the light source is turned on and the detergent is automatically supplied.

Referring to FIGS. 3 to 6D, the controller 110 may determine the amount of the detergent based on the received washing course and the calculated laundry weight. The controller 110 may determine an amount of the washing water to dilute the amount of the detergent to be supplied based on the received washing course and the calculated laundry weight.

When the detergent pump 171 is driven based on the determined amount of the detergent, the controller 110 may operate the detergent light source 15 (e.g., turn on). The user may intuitively confirm whether or not the residual amount exists or whether or not the detergent is supplied through the residual amount indicator 11*a* of the detergent supply case 11 by turning-on of the light source 15.

The controller 110 may drive the detergent pump 171 based on the determined amount of the detergent. The controller 110 may drive the detergent pump 171 to supply the detergent contained in the detergent supply case 11 to the mixing tank 30. The controller 110 may control the water supply unit 141 to supply the washing water to the mixing tank 30. The controller 110 may control so that air at atmospheric pressure may be supplied to the mixing tank 30. The detergent-mixed water mixed in the mixing tank 30 may be discharged to the washing tub (not shown) through the outlet 105A of the detergent case 105 connected through the discharge hose 30*b*.

The controller 110 may control the operation of the detergent pump 171 and the water supply unit 141 until the determined amount of the detergent is reached. When the determined amount of the detergent (or the amount of the detergent-mixed water) is reached, the controller 110 may terminate the operation of the detergent pump 171 and the water supply unit 141. The controller 110 may control the water supply unit 141 based on the determined amount of the washing water to supply the washing water to the washing tub (not shown) through the outlet 105*a* of the detergent dispenser 105.

In another embodiment of the present disclosure, the controller 110 may transmit information corresponding to the calculated detergent amount, the amount of the detergent-mixed water, or the amount of the washing water to the portable terminal 301 of the external devices 300 through the communicator 130. An application that may display information corresponding to the amount of the detergent, the amount of the detergent-mixed water, or the amount of the washing water transmitted from the washing apparatus 100 is executed in the portable terminal 301. Through the executed application, the portable terminal 301 may confirm the operation state of the detergent pump 12 or the operation state of the mixing tank 30.

In operation S950 of FIG. 9, the washing proceeds.

When the supply of the detergent-mixed water, the softening agent-mixed water, or the washing water is completed, the controller 110 may drive the motor 170 based on the received washing course to perform washing. When the washing is in progress, the remaining time until the end of the washing process may be displayed on the display 160. When an abnormality occurs in the washing apparatus 100 during washing, an abnormal state (e.g., a high water temperature) may be displayed on the display 160.

Operation S940 of FIG. 9 and operation S950 of FIG. 9 may be performed simultaneously or sequentially.

In operation S960 of FIG. 9, the light source is turned on and the softening agent is automatically supplied.

Referring to FIGS. 3 to 6D, the controller 110 may determine the amount of the softening agent based on the received washing course and the calculated laundry weight. The controller 110 may determine an amount of the washing water to dilute the amount of the softening agent to be supplied based on the received washing course and the calculated laundry weight.

When the washing of the laundry is completed and the last rinsing in the rinsing process of the laundry is started, and when the softening agent pump 172 is driven based on the determined amount of the softening agent, the controller 110 may operate the softening agent light source 25 (e.g., turn on). The user may intuitively confirm whether or not the residual amount exists or whether or not the softening agent is supplied through the residual amount indicator 21*a* of the softening agent supply case 21 by turning-on of the light source 25.

The controller 110 may drive the softening agent pump 172 based on the determined amount of the softening agent. The controller 110 may drive the softening agent pump 172 to supply the softening agent contained in the softening agent supply case 21 to the mixing tank 30. The controller 110 may control such that air at atmospheric pressure may be supplied to the mixing tank 30. The controller 110 may control the water supply unit 141 to supply the washing water to the mixing tank 30. The softening agent-mixed water mixed in the mixing tank 30 may be discharged to the washing tub (not shown) through the outlet 105*a* of the detergent case 105 connected through the discharge hose 30.

The controller 110 may control the operation of the softening agent pump 172 and the water supply unit 141 until the determined amount of the softening agent is reached. When the determined amount of the softening agent (or the amount of the softening agent-mixed water) is reached, the controller 110 may terminate the operation of the softening agent pump 172 and the water supply unit 141.

The controller 110 may control the water supply unit 141 based on the determined amount of the washing water to supply the washing water to the washing tub (not shown) through the outlet 105*a* of the detergent dispenser 105.

In another embodiment of the present disclosure, the controller 110 may transmit information corresponding to the calculated softening agent amount, the amount of the softening agent-mixed water, or the amount of the washing water to the portable terminal 301 of the external devices 300 through the communicator 130. An application that may display information corresponding to the amount of the softening agent, the amount of the softening agent-mixed water, or the amount of the washing water transmitted from the washing apparatus 100 is executed in the portable terminal 301. Through the executed application, the portable terminal 301 may confirm the operation state of the softening agent pump 22 or the operation state of the mixing tank 30.

The methods according to exemplary embodiments of the present disclosure may be implemented in the form of program instructions that may be executed through various computer means and recorded on a computer-readable medium. The computer-readable medium may include program instructions, data files, data structures, and the like, alone or in combination. For example, the computer-readable medium may, whether erasable or rewritable, be stored in a volatile or nonvolatile storage device such as a ROM, or a memory such as, for example, a RAM, a memory chip, and a device or an integrated circuit, or a storage medium readable by a machine (e.g., a computer) and optically or magnetically recordable such as, for example, a CD, a DVD, a magnetic disk, and a magnetic tape.

It will be appreciated that the memory that may be included in the washing apparatus is an example of a machine-readable storage medium suitable for storing program or programs containing instructions embodying the embodiments of the present disclosure. The program instructions recorded on the medium may be those specially designed and constructed for the present disclosure or may be those available to those skilled in the art of computer software.

As described above, the present disclosure has been described with reference to specific embodiments and specific examples and drawings, which are provided only for a better understanding of the present disclosure, but the present disclosure is not limited to the above-described embodiments, and various modifications and changes may be made thereto by those skilled in the art to which the present disclosure belongs.

Therefore, the spirit of the present disclosure should not be construed as being limited to the above-described embodiments, and it will be understood by those of skilled in the art that the appended claims and their equivalents or equivalent modifications fall within the scope of the present disclosure.

The invention claimed is:

1. A washing apparatus comprising:

a detergent supply case to receive detergent and configured to be insertable into and separable from a receiving portion of a main body of the washing apparatus;

a detergent pump, arranged in an interior of the main body and configured to supply the detergent to a mixing tank having a portion arranged in the interior of the main body, the mixing tank configured to supply a detergent-mixed water having the detergent mixed with water to a detergent dispenser through a siphon module, the mixing tank including a window arranged at an exterior of the main body so that the detergent-mixed water introduced in the mixing tank is viewable from an exterior of the washing apparatus through the window;

a water supply configured to supply the water to the mixing tank; and the detergent dispenser connected to the mixing tank and including an outlet to discharge the detergent-mixed water introduced from the mixing tank to a washing tub.

2. The washing apparatus according to claim 1, wherein the window of the mixing tank includes a transparent material.

3. The washing apparatus according to claim 1, wherein the mixing tank is positioned at a side of the detergent supply case, the detergent supply case includes a residual amount indicator positioned in a front thereof, to allow a remaining amount of the detergent received in the detergent supply case to be intuitively confirmed from an outside through the residual amount indicator.

4. The washing apparatus according to claim 1, further comprising a detergent light source, wherein the detergent light source provides light to the detergent supply case.

5. The washing apparatus according to claim 1, further comprising a softening agent supply case including a residual amount indicator positioned in a front thereof, to allow a remaining amount of a softening agent received in the softening agent supply case to be intuitively confirmed from an outside through the residual amount indicator.

6. The washing apparatus according to claim 1, further comprising a softening agent light source, wherein the softening agent light source provides light to the softening agent supply case.

7. The washing apparatus according to claim 6, wherein a height of an outlet of a siphon pipe is lower than a height of at least one of a detergent inlet of the mixing tank to which the detergent is supplied from the detergent pump, a water inlet of the mixing tank to which the water is supplied from a water supply, and a softening agent inlet of the mixing tank to which the softening agent is supplied from a softening agent pump.

8. The washing apparatus according to claim 1, wherein the mixing tank includes an air inlet connected to a hose for supplying air at atmospheric pressure from the detergent dispenser.

9. The washing apparatus according to claim 8, wherein the siphon module of the mixing tank is provided to discharge the supplied detergent-mixed water to the detergent dispenser using a pressure difference.

10. The washing apparatus according to claim 9, wherein a height of a bottom of the mixing tank is higher than a height of an inlet of a siphon pipe of the siphon module.

11. The washing apparatus according to claim 1, further comprising a mixing tank light source, wherein the mixing tank light source provides light to the mixing tank.

12. A washing apparatus comprising:

a main body;

a door to open and close an upper portion of the main body by a hinge;

a washing tub positioned inside the main body to receive an item to be washed;

a supply assembly including a detergent supply case configured to be inserted into or separated from a receiving portion of the main body of the washing apparatus and receive a detergent;

a softening agent supply case configured to be inserted into or separated from a receiving portion of the main body of the washing apparatus and receive a softening agent;

a detergent pump configured to supply the detergent to a mixing tank;

a softening agent pump configured to supply the softening agent to the mixing tank;

the mixing tank configured to receive at least one of the detergent and the softening agent and receive water;

a water supply configured to supply the water to the mixing tank; and a detergent dispenser to be connected to the mixing tank and including an outlet to receive at least one of a detergent-mixed water and a softening agent-mixed water from the mixing tank to discharge the at least one to the washing tub;

an input configured to receive a selection of a washing course; and a controller configured to control the detergent pump and the softening agent pump and the input, wherein the controller controls to generate the detergent-mixed water by calculating a weight of the item to be washed in response to a detection of the door being close and the selection of the washing course, determines a detergent amount based on the calculated weight of the item to be washed, automatically supplies the detergent based on the determined detergent amount to the mixing tank by the driving of the detergent pump, and supplies the water to the mixing tank.

13. The washing apparatus according to claim 12, wherein the controller controls to generate the softening agent-mixed water by calculating the weight of the item to be washed in response to a detection of the door being close and the selection of the washing course, determining a softening agent amount based on the calculated weight of the item to be washed, automatically supply the softening agent based on the determined softening agent amount to the mixing tank by the driving of the softening agent pump, and supply the water to the mixing tank.

14. The washing apparatus according to claim 12, further comprising a plurality of light sources, wherein the plurality of light sources includes a detergent light source, a softening agent light source, and a mixing tank light source.

15. The washing apparatus according to claim 14, wherein the controller controls an operation of the detergent light source based on the automatic supply of the detergent.

* * * * *